US011142288B2

(12) United States Patent
Petersen et al.

(10) Patent No.: US 11,142,288 B2
(45) Date of Patent: Oct. 12, 2021

(54) BENDING STRAIN RELIEF ASSEMBLY FOR MARINE CABLES INCORPORATING AT LEAST ONE ELONGATED STIFFNESS MEMBER

(71) Applicant: PMI INDUSTRIES, INC., Cleveland, OH (US)

(72) Inventors: Carl C. Petersen, Mentor, OH (US); Jay C. Marino, South Euclid, OH (US); Konstantin Nakovski, Bedford, OH (US); Robert G. Gannon, North Olmsted, OH (US); Allan R. Metzler, Sr., Highland Heights, OH (US)

(73) Assignee: PMI INDUSTRIES, INC., Cleveland, OH (US)

( * ) Notice: Subject to any disclaimer, the term of this patent is extended or adjusted under 35 U.S.C. 154(b) by 137 days.

(21) Appl. No.: 14/440,134

(22) PCT Filed: Nov. 4, 2013

(86) PCT No.: PCT/US2013/068316
§ 371 (c)(1),
(2) Date: May 1, 2015

(87) PCT Pub. No.: WO2014/071305
PCT Pub. Date: May 8, 2014

(65) Prior Publication Data

US 2015/0266546 A1 Sep. 24, 2015

Related U.S. Application Data

(60) Provisional application No. 61/814,661, filed on Apr. 22, 2013, provisional application No. 61/721,905, filed on Nov. 2, 2012.

(51) Int. Cl.
*B63B 21/04* (2006.01)

(52) U.S. Cl.
CPC ..... *B63B 21/04* (2013.01); *Y10T 29/49959* (2015.01)

(58) Field of Classification Search
CPC ... B63B 21/04; B63B 21/08; Y10T 29/49959; F16K 55/179; F16L 57/02; F16L 57/00;
(Continued)

(56) References Cited

U.S. PATENT DOCUMENTS 2,352,158 A 6/1944 Bishop
3,996,414 A * 12/1976 Artbauer ..... H01B 7/0233 174/28

(Continued)

OTHER PUBLICATIONS

PCT/US2013/068316, "International Search Report and Written Opinion", dated Jun. 16, 2014.

*Primary Examiner* — Christopher Garft
(74) *Attorney, Agent, or Firm* — Fay Sharpe LLP

(57) ABSTRACT

The present disclosure relates to a bending strain relief (BSR) assembly that limits the bending strain and radius of a marine cable. The BSR assembly includes a coupler attached to first and second elongated BSR members, each BSR member having first and second ends distally spaced from the first end. The first ends including an abutment surface dimensioned for attachment to the coupler. The BSR members each have an inner arcuate surface that is adapted to abut at least a portion of a perimeter of the marine cable and dimensioned for mating receipt with one another at opposing sides of the marine cable. A plurality of rigid support members are disposed in spaced relation and aligned along a common axis and the inner arcuate surfaces of the first and second elongated BSR members. The cable is supported within the inner arcuate surfaces of the first and second BSR members.

20 Claims, 32 Drawing Sheets

(58) Field of Classification Search
CPC ..... F16L 11/123; F16L 35/00; F16L 55/179; F16L 1/123; E21B 17/017; G02B 6/44; H01R 13/533
USPC ..... 248/542; 174/99 R, 101.5, 27, 42; 367/75, 20; 138/110, 106; 285/134.1
See application file for complete search history.

(56) References Cited

U.S. PATENT DOCUMENTS

| | | | | | |
|---|---|---|---|---|---|
| 4,427,033 | A * | 1/1984 | Ege | F16L 11/12 | 138/103 |
| 4,469,392 | A | 9/1984 | Edgerton et al. | | |
| 4,502,189 | A | 3/1985 | Sieberkrob et al. | | |
| 5,062,085 | A * | 10/1991 | Andrews, Jr. | B63B 21/56 | 174/101.5 |
| 5,274,603 | A * | 12/1993 | Zibilich, Jr. | G01V 1/201 | 174/101.5 |
| 5,367,499 | A * | 11/1994 | Morningstar | B63B 21/66 | 174/101.5 |
| 5,707,252 | A | 1/1998 | Meszaros | | |
| 5,710,851 | A | 1/1998 | Walter et al. | | |
| 6,262,944 | B1 * | 7/2001 | Meyer | G01V 1/201 | 174/101.5 |
| 6,880,219 | B2 * | 4/2005 | Griffioen | F16L 41/023 | 285/126.1 |
| 2013/0270414 | A1 * | 10/2013 | McGovern, Jr. | F16F 7/14 | 248/610 |

* cited by examiner

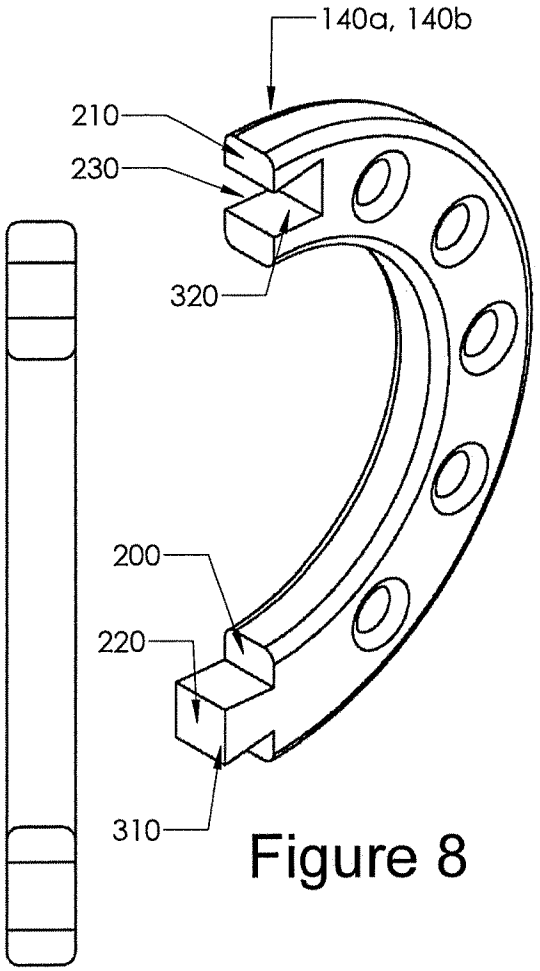
Figure 8
Figure 8A
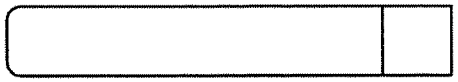
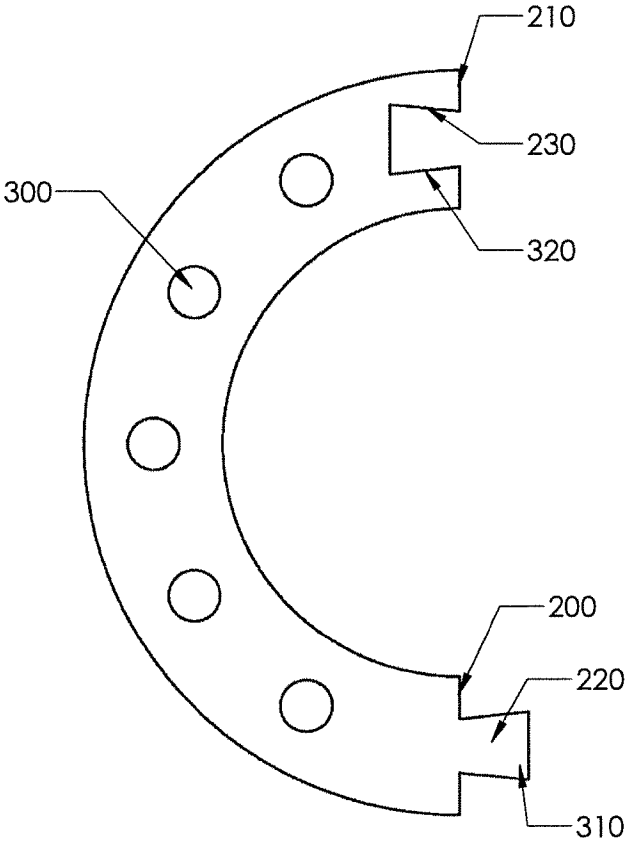
Figure 8B
Figure 8C 155
340

130b
370
350
360
130a
375
360
350
330a
370
100
370
380

320
190
120
110

130b
130
130a
370
B
B
330b
330a
330
380
100
F
F
340
120
110

330b
340
330a

130b

140b

120

120

145b
260
270

130b

A
A
B
B
C
C
D
D
E
E
120
260

120
140b
145b
150
390

BENDING STRAIN RELIEF ASSEMBLY FOR MARINE CABLES INCORPORATING AT LEAST ONE ELONGATED STIFFNESS MEMBER

BACKGROUND

This disclosure relates to a protective device received over an elongated flexible structure such as a cable, cable array or bundle of cables or wires, and more particularly to a bending strain relief (BSR) assembly to provide strain relief by limiting a bending radius of the associated cable and will be described with particular reference thereto.

A BSR assembly will provide varying levels of resistance to bending. In a sense it does bend limiting since the BSR assembly increases the bend radius with resistance if it can. If the resistance is overcome by large cable tension, the BSR assembly can bend further.

The BSR assembly is prominently used in an environment that places special demands on the device. Specifically, long cables and/or bundles of cables or wires are towed behind a marine vessel and, for example, include sensing devices distributed in the tentacles of the end of the cable. The sensors can be used for a variety of uses, for example, seismic exploration is one common use. Loads and dynamic forces imposed on the cable or cable array are extensive, and the cable must be adaptable to dynamic forces.

The BSR assemblies are used, for example, at a terminal end or a junction of submarine cables. It is important for the BSR assembly to be easily assembled or disassembled as the cable or cable array is positioned behind the vessel. It is desirable that the BSR assembly be attachable and detachable to the cable in place without having to detach the cable from the vessel. Further, it is desired that the BSR assembly be adaptable to various cable sizes, and capable of self-return, i.e., exert a resilience or biasing force that urges the cable to an undeflected state. Additionally, this feature serves to dampen forces and sound.

Minimizing the number of components is important with regard to inventory. Simply stated, less components means there is less inventory that must be maintained on hand either for original assembly or repair.

Yet another issue is the desire to simplify assembly. Any improvement that reduces assembly time or ease of assembly is a welcome modification. Reducing connection points and the amount of parts to the assembly simplifies the method for assembly in difficult environments such as on a ship deck.

Consequently, a need exists for an improved BSR assembly that satisfies these needs and overcomes other problems in the industry in a manner that is simple, reliable, effective, and economical.

SUMMARY

Provided is a BSR assembly that limits bending strain and the bending radius of an associated cable or bundle of cables. In one embodiment, the BSR assembly includes a coupler having a first end and an opposite second end with a longitudinal inner surface that extends from the first end to the second end and has a curved profile or inner arcuate surface. A first elongated BSR member has a proximal end and a distal end spaced from the proximal end with an inner arcuate surface that extends between the proximal end and a distal end. The first BSR member is dimensioned for attachment to the coupler along a portion of an interface surface along a second end of the coupler and the proximal end of the first BSR member such that the inner arcuate surface is aligned with a longitudinal inner surface of the coupler.

A second elongated BSR member has a proximal end and a distal end spaced from the proximal end, and an inner arcuate surface. The second BSR member is dimensioned for attachment to the coupler along a portion of the interface surface along the second end of the coupler and the proximal end of the second BSR member such that the inner arcuate surface is aligned with the longitudinal inner surface of the coupler. The cable is configured to be supported within the longitudinal inner surface and the inner arcuate surfaces of the first and second elongated BSR members.

The first and second BSR members include a plurality of rigid support members generally aligned in axially spaced relation along a common axis and surrounding the inner arcuate surfaces of the first and second elongated BSR members. In one embodiment, the BSR members are slidably attached to one another in surrounding or encompassing relation with the cable.

Also provided is a method of assembling a BSR assembly to a marine cable. The method includes providing a coupler with a longitudinal inner surface along the marine cable. First and second BSR members are supplied, each member having an arcuate inner surface dimensioned to interface with the coupler and to support the marine cable. The method additionally includes providing a plurality of rigid support members axially aligned in axially spaced relation along the first and second BSR members. The first BSR member is slidably connected to the second BSR member on opposing sides of the cable such that the first and second BSR members attach to the coupler along an interface surface.

Another embodiment of the present disclosure relates to a BSR assembly that limits the bending radius of an associated marine cable. The BSR assembly includes a sleeve member configured to be secured to a perimeter of the associated marine cable to prevent relative axial movement thereon. A coupler has a first end and an opposite second end with a longitudinal inner surface that extends from the first end to the second end, and the coupler is attached to the sleeve member at the first end.

First and second elongated BSR members are also provided. Each BSR member has a first end and a second end distally spaced from the first end. The first ends include an abutment surface dimensioned for attachment to the coupler. The BSR members have an inner arcuate surface that is adapted to receive at least a portion of the perimeter of the associated marine cable and are dimensioned for mating receipt with one another at opposing sides (i.e., along opposite diametrical portions) of the associated marine cable. A plurality of rigid support members are generally aligned along a common axis in axially spaced relation and have inner arcuate surfaces of the first and second elongated BSR members wherein the associated marine cable is configured for receipt within the longitudinal inner surface and the inner arcuate surfaces of the first and second elongated BSR members. The first and second elongated BSR members include identical mating portions that are selectively secured together along an interface surface by sliding one elongated BSR member relative to the other.

One advantage of the present disclosure relates to the ease of assembly.

Another advantage corresponds to the reduced inventory issues by integrally securing the resilient member.

Still other benefits and advantages of the present disclosure will become apparent to those skilled in the art upon reading and understanding the following detailed description.

BRIEF DESCRIPTION OF THE DRAWINGS

FIG. 8 is a perspective view of another embodiment of the rigid support member of the BSR assembly.

FIG. 8A is an end view of the rigid support member of FIG. 8.

FIG. 8B is a side view of the rigid support member of FIG. 8.

FIG. 8C is a bottom view of the rigid support member of FIG. 8.

DETAILED DESCRIPTION

Figure 1:
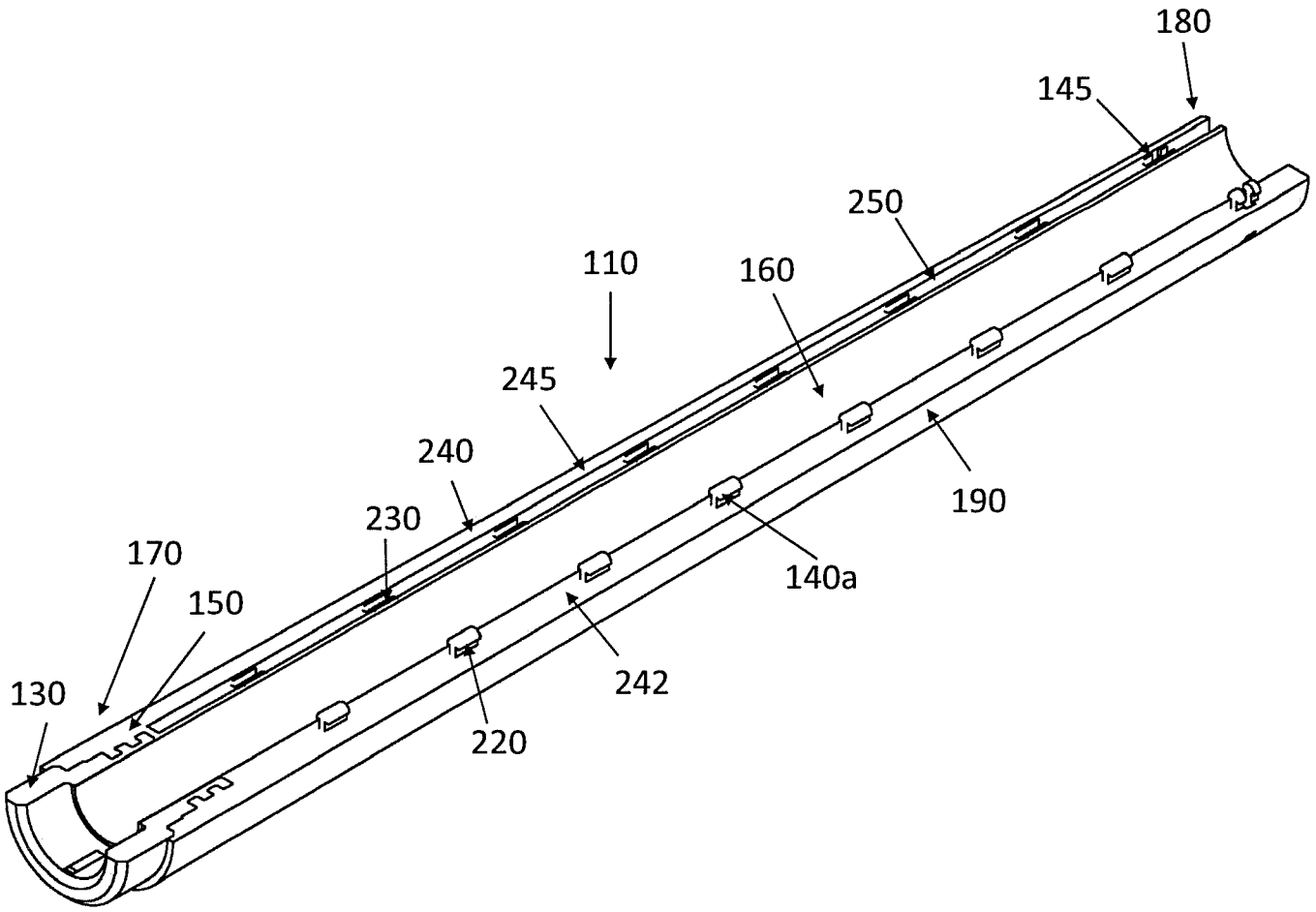
FIG. 1 illustrates a perspective view of a first BSR member that comprises a first or bottom half of a BSR assembly according to a preferred embodiment.
Figure 2:
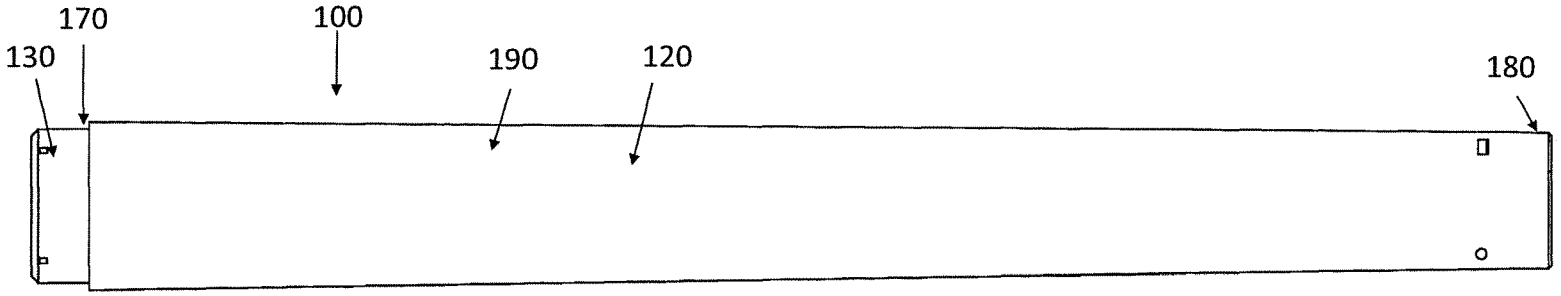
FIG. 2 is a side view of the BSR assembly comprising the first BSR member of FIG. 1 as it is attached to a second BSR member.
Figure 4:
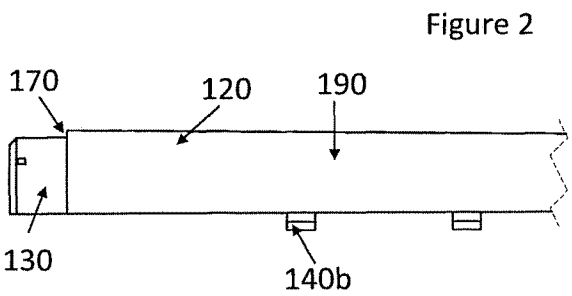
FIG. 4 is a side view of the second BSR member that includes a second or top half of the BSR assembly according to a preferred embodiment.
Figure 3:
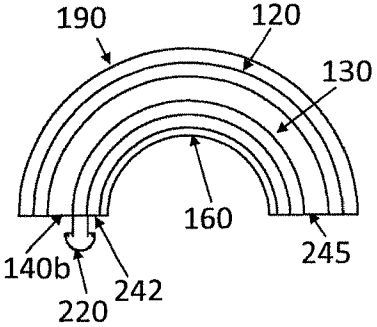
FIG. 3 is an enlarged end view of the second BSR member of FIG. 4.
Figure 5:
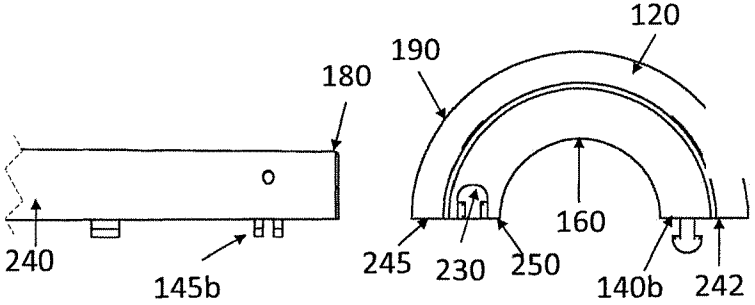
FIG. 5 is an enlarged end view of the second BSR member of FIG. 4.

FIGS. 1 and 2 illustrate one embodiment of a bending strain relief (BSR) assembly 100 that includes a first elongated bending strain relief (BSR) member 110 (FIG. 1) that is configured to slidably attach and detach from a second elongated BSR member 120 identical to the first BSR member (FIG. 2) to limit the bending radius of an associated marine cable (not shown). The BSR assembly 100 includes a transition member or coupler 130 that supports the attachment of the first and second elongated BSR members 110, 120 as the BSR members are positioned along the cable. The BSR members 110, 120 can be made from an elastomer material, for example a polyurethane material or a polyurethane material with strengthening material such as carbon fibers or the like, although other materials that can withstand the rigors of the end use environment may be used without departing from the scope and intent of the present disclosure, and that include axially spaced, plural support members (that may or may not be interconnected by one or more elongated stiffness members) as will be described in greater detail below.

With reference to FIG. 1, and additional reference to FIGS. 9-12, each elongated BSR member 110, 120 has an inner arcuate surface 160 that defines a circumferentially continuous inner perimeter portion of the assembly 100. The inner perimeter portion receives the marine cable therein. As will be appreciated, each of the BSR members 110, 120 has a proximal end 170 and a distal end 180 spaced from the proximal end 170. The arcuate surface 160 extends continuously along the bend limiting members 110, 120 and, in one embodiment, includes a half circle or generally C-shaped profile.

BSR members 110, 120, once assembled, create a generally hollow sleeve-like component such that the inner arcuate surfaces 160 are aligned to form a cavity dimensioned to receive and support an outer perimeter surface of the cable. In addition, an outer surface 190 of the combined BSR members 110, 120 extends between the proximal 170 and distal ends 180 and has a generally arcuate or rounded profile. As will be appreciated, the BSR members 110, 120 have a generally cylindrical shaped cross-sectional profile so that the proximal end 170 is attached to the coupler 130 as the inner arcuate surfaces 160 can be generally aligned with the longitudinal inner surface of the coupler 130 and support, engage, or abut a perimeter surface of the cable (not shown). In addition, the coupler 130 is attached to the elongated BSR members 110, 120 along an interface surface 150 and can be made of a corrosion resistant metal. However, it is contemplated that other materials can be used to make the coupler 130.

Plural support members 140*a*, 140*b* are provided at axially spaced locations along the first and second BSR members 110, 120, respectively. The support members 140*a*, 140*b* can be arranged internally of the bend limiter members 110, 120 (i.e., at least partially encased or encapsulated in the elastomer or polyurethane material that forms a body of the first and second BSR members) and the support members preferably have a generally C-shaped body profile that resembles the corresponding arcuate surfaces 160. FIG. 1 illustrates eight (8) support members 140*a* that are distributed or axially spaced along the length of the first BSR member 110, although the particular number of support members may be varied without departing from the scope and intent of the present disclosure. In this embodiment, the second elongated BSR member 120 also includes eight (8) support members 140*b* and is configured to complement the eight (8) support members 140*a* of the first BSR member 110. However, it is contemplated that two or more support members 140*a*, 140*b* can be utilized in accordance with this disclosure. The range of bending motion of the BSR assembly 100 is reinforced by the elastomer material of the elongated BSR members 110, 120 and the number of support members 140*a*, 140*b* so that a total bending or curvature of the cable or array of cables, relative to the coupler 130, is limited by the surrounding first and second BSR members 110, 120.

A distal support member 145*a* is located at the distal end 180 of the first BSR member 110 and is configured to align with a distal support member 145*b* of the second BSR member 120 and receive at least one pin 155 (FIG. 11) to secure or fasten the first and second BSR members 110, 120 in place about the cable and to prevent axial shifting relative to members 110 and 120 during bending, and as will be described in greater detail below.

The plurality of rigid support members 140 are axially spaced apart and generally aligned along a common axis and the inner arcuate surfaces 160 of the first and second elongated BSR members 110, 120, respectively. The plurality of rigid support members 140*a* of the first elongated BSR member 110 are configured to axially align with the plurality of rigid support members 140*b* of the second elongated BSR member 120.

As clearly illustrated by FIGS. 6A, 6B, 7, and 8, the plurality of rigid support members 140*a*, 140*b* each include a first end 200 and a second end 210 on opposing sides of an inner arcuate surface 165 of each support member 140*a*, 140*b*. A protrusion member 220 extends from the first end 200 and a protrusion receiving member 230 is recessed from the second end 210 of each support member 140*a*, 140*b*. The protrusion members 220 and the protrusion receiving members 230 are configured to align along an edge surface 240 of both the first and second elongated BSR members 110, 120. The edge surface 240 includes a first surface 242 and a second surface 245 separate from the first surface 242 and is generally aligned on a common plane wherein the inner arcuate surface 160 is between the first surface 242 and the second surface 245. The protrusion members 220 extend from the first surface 242 of the edge surface 240 and the protrusion receiving members extend from the second surface 245 of the edge surface 240. In this embodiment, the edge surface 240 is a planar surface and the first surface 242 is generally parallel to and spaced from the second surface 245. The arcuate inner surface 160 axially extends between the first side 242 and the second side 245 of the edge surface 240.

The first and second elongated BSR members 110, 120 each include a channel 250 that extends between the proximal end 170 and the distal end 180 and is aligned with the plurality of protrusion receiving members 230 of the rigid support members 140*a*, 140*b* along the edge surface 240. The channel 250 is spaced radially from the arcuate inner surfaces 160 and is recessed from a first side 245 of the edge surface 240. The channel 250 is configured to simultaneously receive the plurality of protrusion members 220 from the support members 140*a*, 140*b* of the other of the first and second BSR members 110, 120. In this embodiment, the first elongated BSR member 110 is a corresponding mirror equivalent to the second elongated BSR member 120.

Figure 6B:
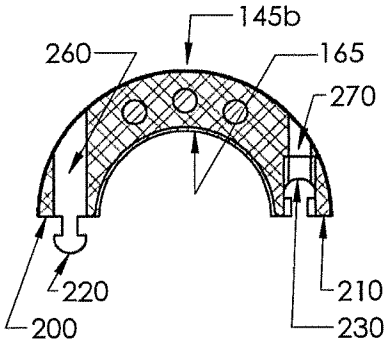
FIG. 6B is an enlarged cross-sectional view of one embodiment of the rigid support member of the second BSR member of FIG. 6.
Figure 6A:
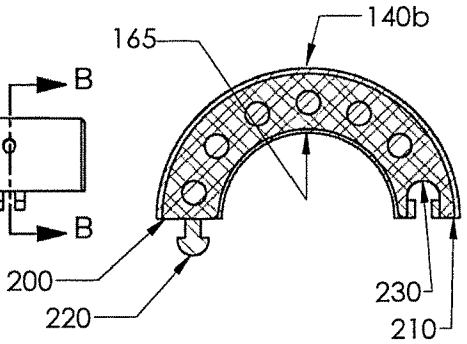
FIG. 6A is an enlarged cross-sectional view of one embodiment of a rigid support member of the second BSR member of FIG. 6.
Figure 6:
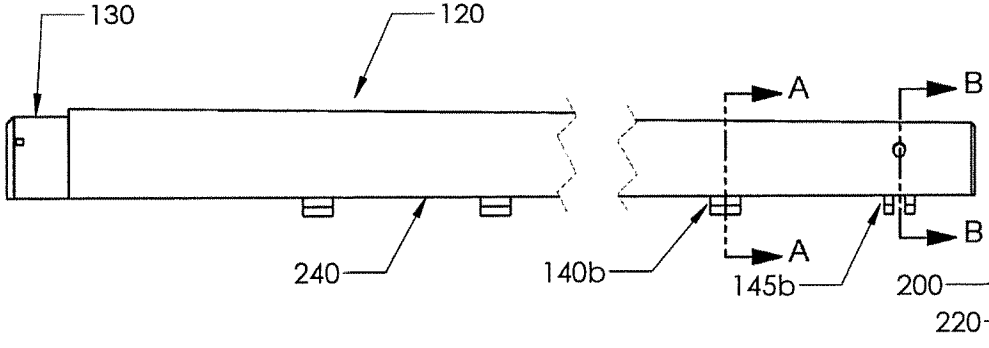
FIG. 6 is a side view of the second BSR member that comprises a second or top half of the BSR assembly according to a preferred embodiment.

Illustrated by FIG. 6B, distal support member 145*b* includes a first keyway 260 that is aligned with the protrusion member 220 along the first end 200 and a second keyway 270 that is aligned with the protrusion receiving member 230 along the second end 210. Each keyway extends substantially perpendicularly from the first end 200 and second end 210, respectively, to the outer surface 190 of each elongated BSR member 110, 120. Once the first and second elongated BSR members are attached around the cable, the first and second keyways 260, 270 are configured to align with a corresponding keyway of a corresponding distal support member 145*b* such that the combined keyways extend from opposing outer surfaces 190 of each BSR member 110, 120. A fastener or pin can be received within each keyway to prevent disengagement of the first elongated BSR member 110 with the second BSR member 120.

Figure 7:
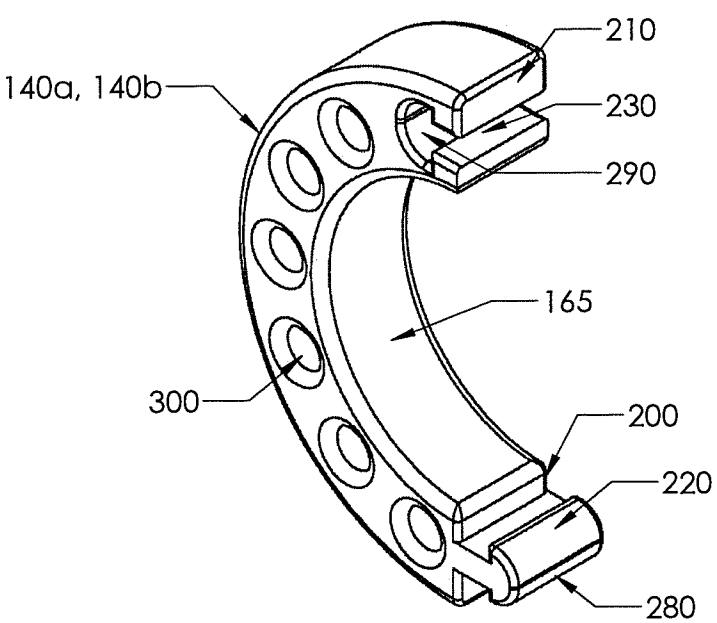
FIG. 7 is a perspective view of one embodiment of the rigid support member of the BSR assembly.
Figure 7A:
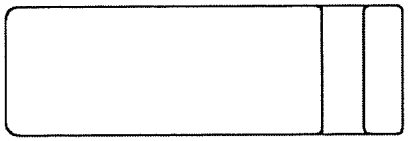
FIG. 7A is an end view of the rigid support member of FIG. 7.
Figure 7C:
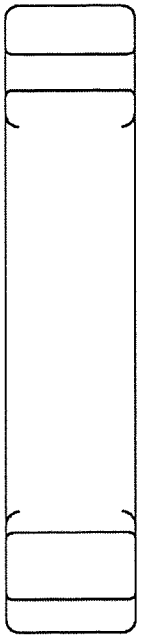
FIG. 7C is a bottom view of the rigid support member of FIG. 7.
Figure 7B:
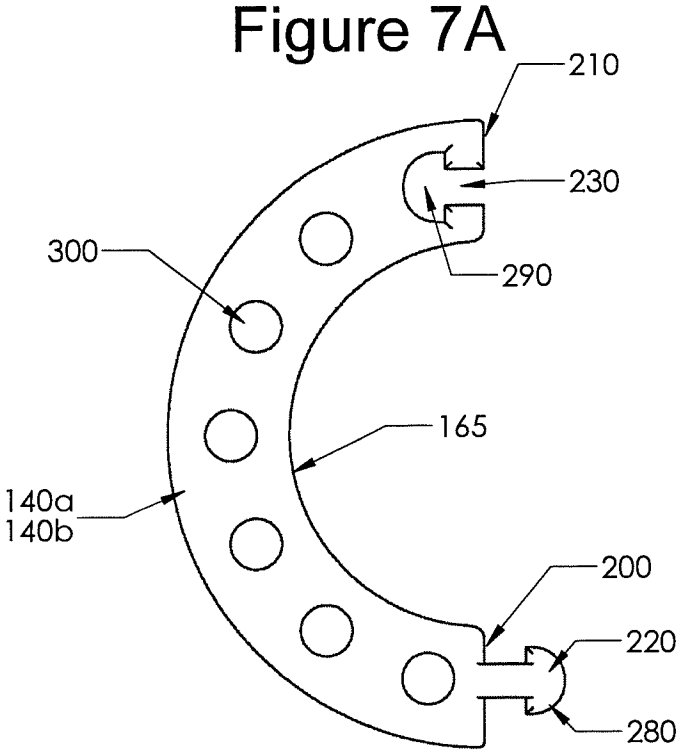
FIG. 7B is a side view of the rigid support member of FIG. 7.
Figure 9:
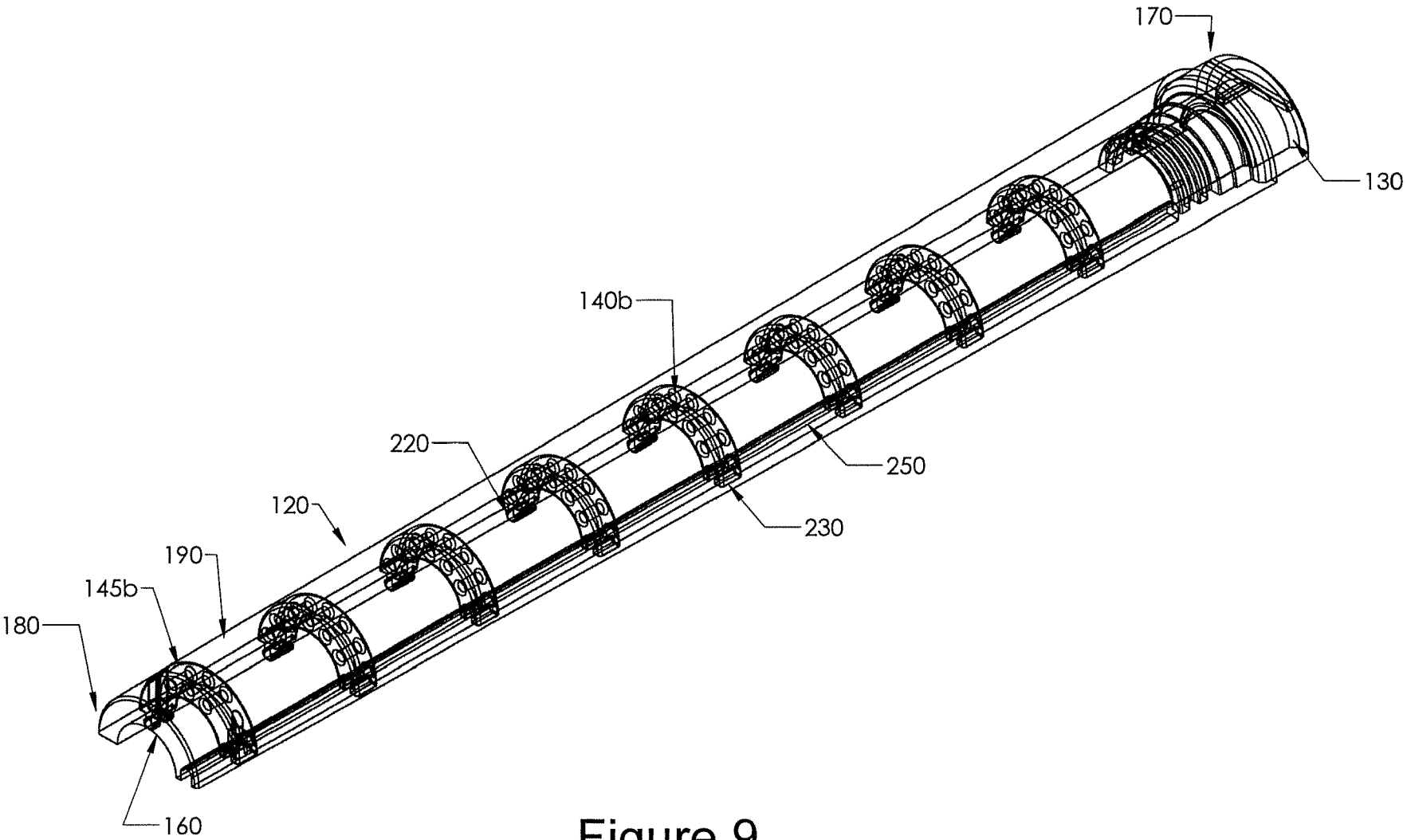
FIG. 9 is a perspective outline view of one embodiment of the second elongated BSR member with a plurality of rigid support members.

FIGS. 7 and 8 illustrate separate embodiments of the support members 140*a*, 140*b*. The support member 140*a* can be provided with protrusion member 220 and a protrusion receiving member 230 having different shaped profiles. The protrusion member 220 of FIG. 7 has a hemispherical or mushroom-cap shaped head 280 and the protrusion receiving member 230 includes a correspondingly shaped profile 290 that is dimensioned to slidingly receive the hemispherical shaped head 280. Similarly, the protrusion member 220 of FIG. 8 has a tapered shaped head or key 310 and the protrusion receiving member 320 includes a correspondingly shaped profile or recess 320 that is dimensioned to slidingly receive the tapered shaped head 310. As evident from the two examples illustrated in FIGS. 7 and 8, the profile shape of the protrusion member and protrusion receiving member can vary and the disclosure is not limiting and contemplates this corresponding feature.

Additionally, the support member can be provided with a plurality of apertures 300 spaced between the first end 200 and the second end 210 to provide additional structural integrity and to aid in the attachment of the support member 140*a*, 140*b* to the BSR members 110, 120. More particularly, the support members can be integrally formed within an inner cavity of the BSR members such that elastomeric material extends through the apertures 300. Also, in one embodiment, the support member apertures may receive, for example, at least one elongated stiffness member such as a wire, stranded nylon rope and/or helical rods or spring steel threaded rods extending through multiple support members to increase bending stiffness in the BSR assembly as will be discussed more fully below.

As illustrated by FIGS. 9-12, the BSR members 110, 120 are formed of cooperating portions such as symmetrical halves. The support members 140*a*, 140*b* act as cooperating receiving portions. The method of assembling the BSR assembly 100 to a marine cable includes steps that are designed to simplify maintenance of a marine cable array as it remains extended behind a vessel or when reeled in to the deck of a ship. The coupling or coupler 130 is provided along the perimeter of the marine cable, and the coupler 130 includes the interface surface 150. Initially, the first elongated BSR member 110 can be attached to the interface surface 150 of the coupling such that the inner arcuate surface 160 can support the marine cable (see FIGS. 11 and 12).

Figure 10:
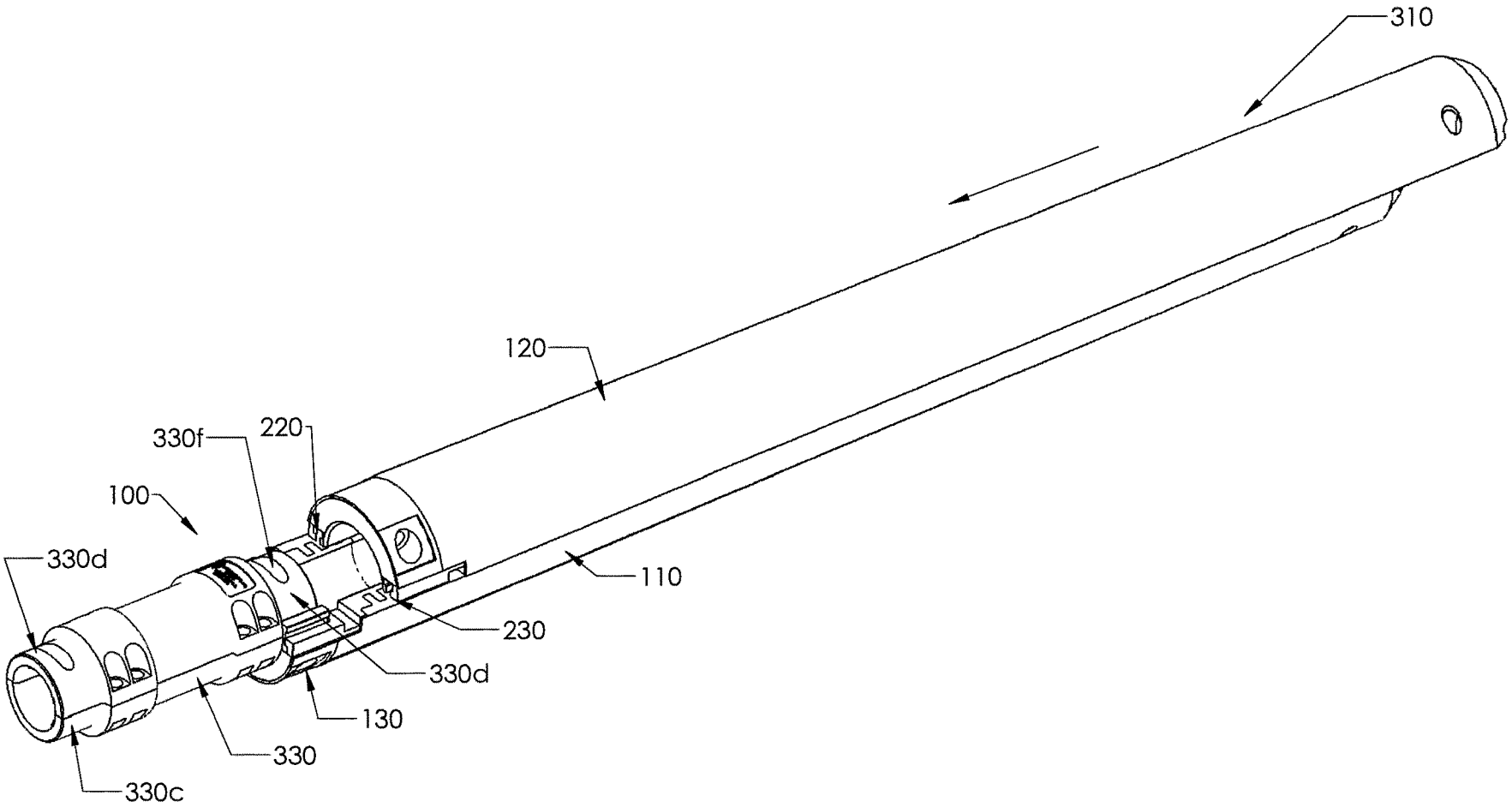
FIG. 10 is a perspective view of the BSR assembly wherein the second elongated BSR member is slidably attached to the first elongated BSR member.

The second elongated BSR member 120 is placed in a first axial position 310 relative to the first elongated BSR member 110 such that the inner arcuate surface 160 of the second elongated BSR member 120 can also receive the marine cable (see FIG. 10). In the first axial position where the BSR members 110, 120 are axially offset from one another, the second elongated BSR member 110 is positioned axially away from the coupler 130 such that the protrusion members 220 of the first elongated BSR member 110 can be subsequently inserted (such as by a sliding movement of one BSR member relative to the other BSR member) into the channels 250 of the second elongated BSR member 120 and the protrusion members 220 of the second elongated BSR member 120 can be inserted into the channels 250 of the first elongated BSR member 110. However, the protrusion members 220 and the protrusion receiving members 230 remain axially spaced from one another in this initial make-up position.

Figure 11:
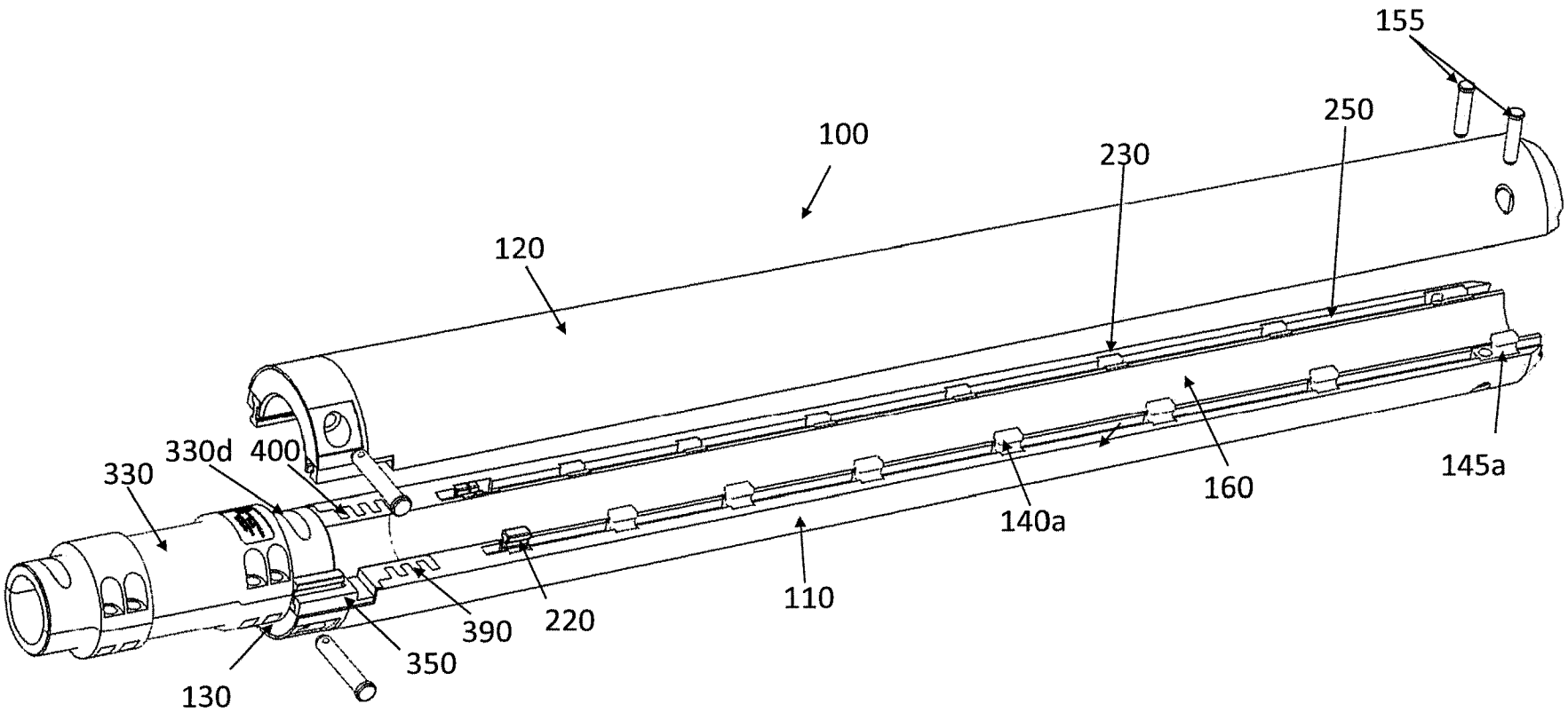
FIG. 11 is a perspective view of the BSR assembly wherein the second elongated BSR member is detached from the first elongated BSR member.
Figure 12:
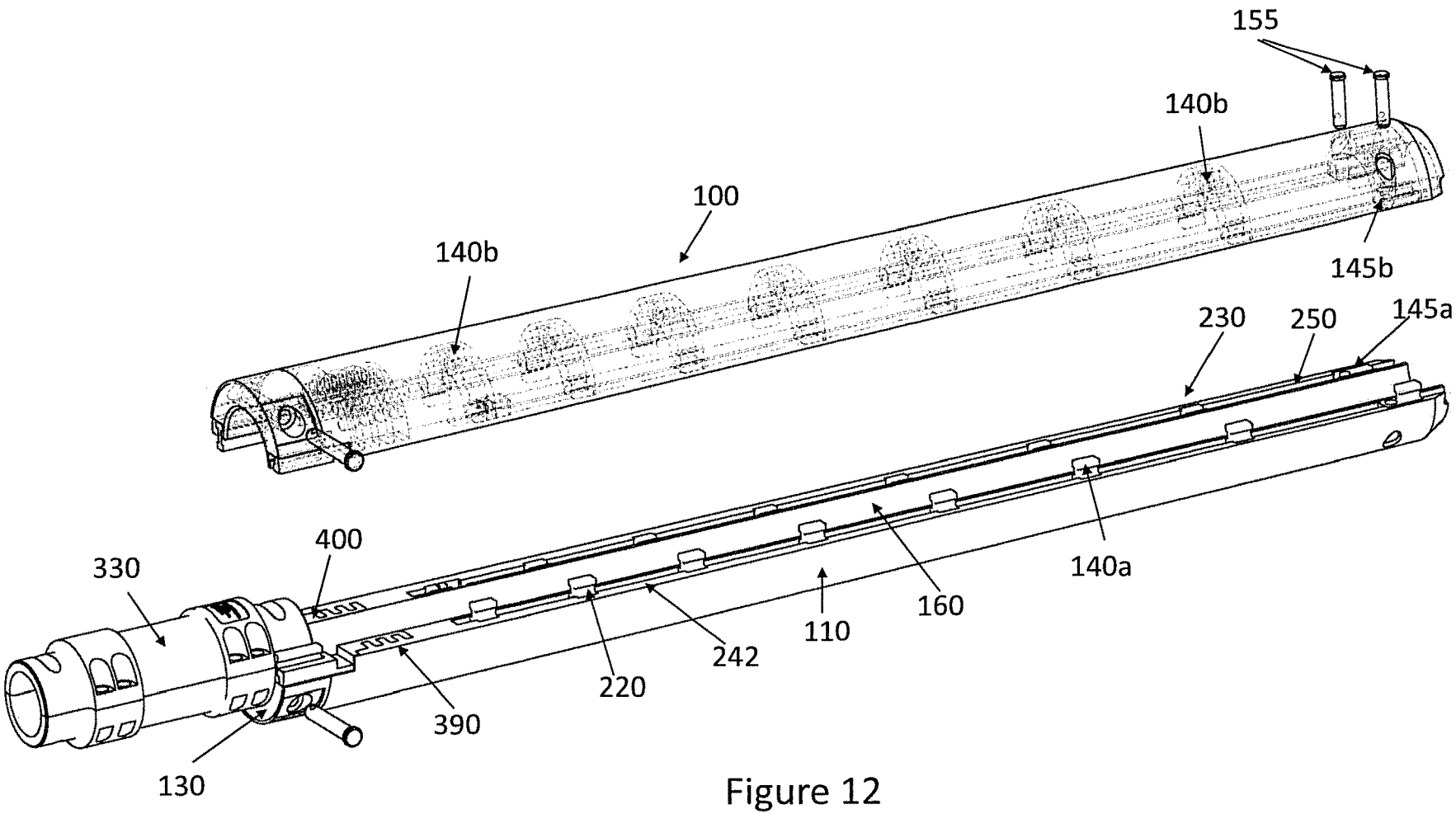
FIG. 12 is a perspective view of the BSR assembly wherein the second elongated BSR member is detached from the first elongated BSR member.

As is also shown in FIGS. 10-12, at least one window or port 350 may also be provided in assembly 100, and preferably a port 350 is provided on each generally diametrical side. This port(s) preferably extends through the coupler 130 and allows a user to view the integrity of the cable, connection, etc., e.g., whether there is any corrosion, abrasion, and/or stress and fatigue failure of the assembly, cable, or reinforcement, etc. The ports 350 are sized to simultaneously serve the purpose of a flushing port through which seawater can easily pass, as well as being used as a view port or window, and therefore preferably extend through both the coupler and the polyurethane material of the BSR member.

Figures 13A, 13B, 13C, 13D, 13E, 13F:
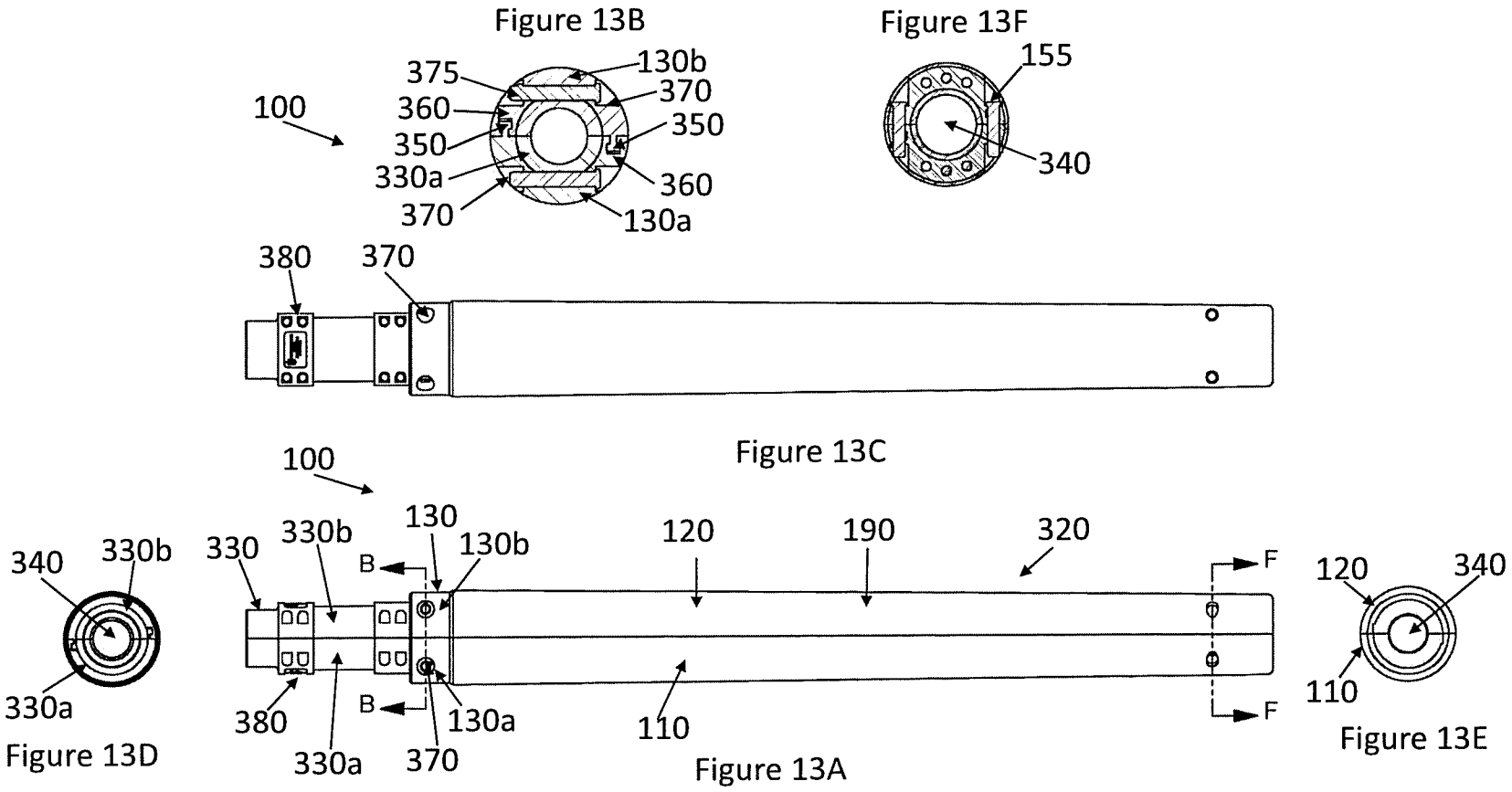
FIG. 13A is a side view of one embodiment of the BSR assembly according to a preferred embodiment.
FIG. 13B is a cross-sectional view of the BSR assembly of FIG. 13A.
FIG. 13C is a top view of the BSR assembly of FIG. 13A.
FIG. 13D is an end view of the BSR assembly of FIG. 13A.
FIG. 13E is an end view of the BSR assembly of FIG. 13A.
FIG. 13F is a cross-sectional view of the BSR assembly of FIG. 13A.

The first and second elongated BSR members 110, 120 are moved relative to one another from the offset, first axial position 310 to the aligned, second axial position 320 (FIG. 13A) to connect the second elongated BSR member 120 to the first elongated BSR member 110 about the perimeter of the marine cable. The second elongated BSR member 120 can be attached to the interface surface 150 of the coupling 130. However, it is also an option to attach the coupler 130 to both the first and second elongated BSR members 110, 120 after the first BSR member has been connected to the second BSR member around the perimeter of the cable. A sleeve member 330 can also be provided along the marine cable and be attached to the coupler 130. The sleeve member 330 is preferably rigidly attached to the cable and adapted or configured to prevent axial movement of the assembly 100 along the cable.

Consequently, each BSR member 110, 120 has a circumferential or arcuate length that generally corresponds to the partial circumferential extent of each BSR member portion, e.g., is generally C-shaped, so that when the portions are assembled together, cooperating C-shaped elastomeric members form a generally continuous resilient assembly that surrounds the perimeter of the cable. By integrally securing the support members 140*a*, 140*b* that include protrusion members 220 and protrusion receiving members 230 into the respective BSR members, the assembly 100 is simplified. Less components are handled during assembly, inventory is reduced, and assembly accuracy is improved because the support members 140*a*, 140*b* (that include the protrusions 220 and protrusion receiving members 230) are integrated into the assembly 100.

As shown, the BSR members 110, 120 preferably have a rounded outer contour surface 190 facing outwardly from the edge surface for selective engagement with a facing edge surface of the BSR member from the opposite side of the cable. When assembled, respective ends 170, 180 of BSR members 110, 120 are free to articulate relative to the coupler 130 and sleeve member 330. The maximum extent of articulation is defined by the axial length of the BSR members and the number of support members therein. In addition, the BSR members 110, 120 allow the articulating movement of the cable, and when forces are relaxed, the members 110, 120 urge the cable toward an undeflected, generally linear orientation. By making each support member and BSR member 110, 120 identical to the other, manufacturing and inventory concerns are addressed.

FIGS. 13A-13F illustrate different views of the assembly 100 as fully assembled and without a cable through a passage 340 created by the inner arcuate surfaces 160 of the first and second elongated BSR members 110, 120. In this embodiment, the coupler 130 can be assembled to the cable with a first coupler member 130*a* and a second coupler member 130*b*. The coupler members 130*a*, 130*b* are connected to one another in a similar fashion as the first and second elongated bend limiter members 110, 120. Each coupler member includes a protrusion member 350 and a corresponding protrusion receiving member 360 that are slidably attached to one another. Additionally, the coupler 130 can include fastener receiving openings 370 that receive a respective fastener 375 to attach the coupler 130 to the sleeve member 330 along the cable. Additionally, it is contemplated that various alternative fastening arrangements may be employed.

Accordingly, the sleeve member 330 can be assembled to the cable with a first sleeve member 330*a* and a second sleeve member 330*b*. Each of the sleeve members can be formed with a similar profile to the other, again, for ease of manufacture and assembly. Each sleeve member 330*a*, 330*b* includes at least a first pair of fastener openings 380 in which the openings are dimensioned to receive a threaded end of like fasteners therethrough. Related to the coupler 130 and sleeve member 330, the relative fasteners can include a conventional fastener head that is configured to receive an associated assembly tool (not shown) and the fastener head is dimensioned so that the fastener may be fully received in the openings 370, 380 but is prevented from passing completely therethrough.

Figures 14, 14A, 14B, 14C, 14D, 14E, 14F, 14G:
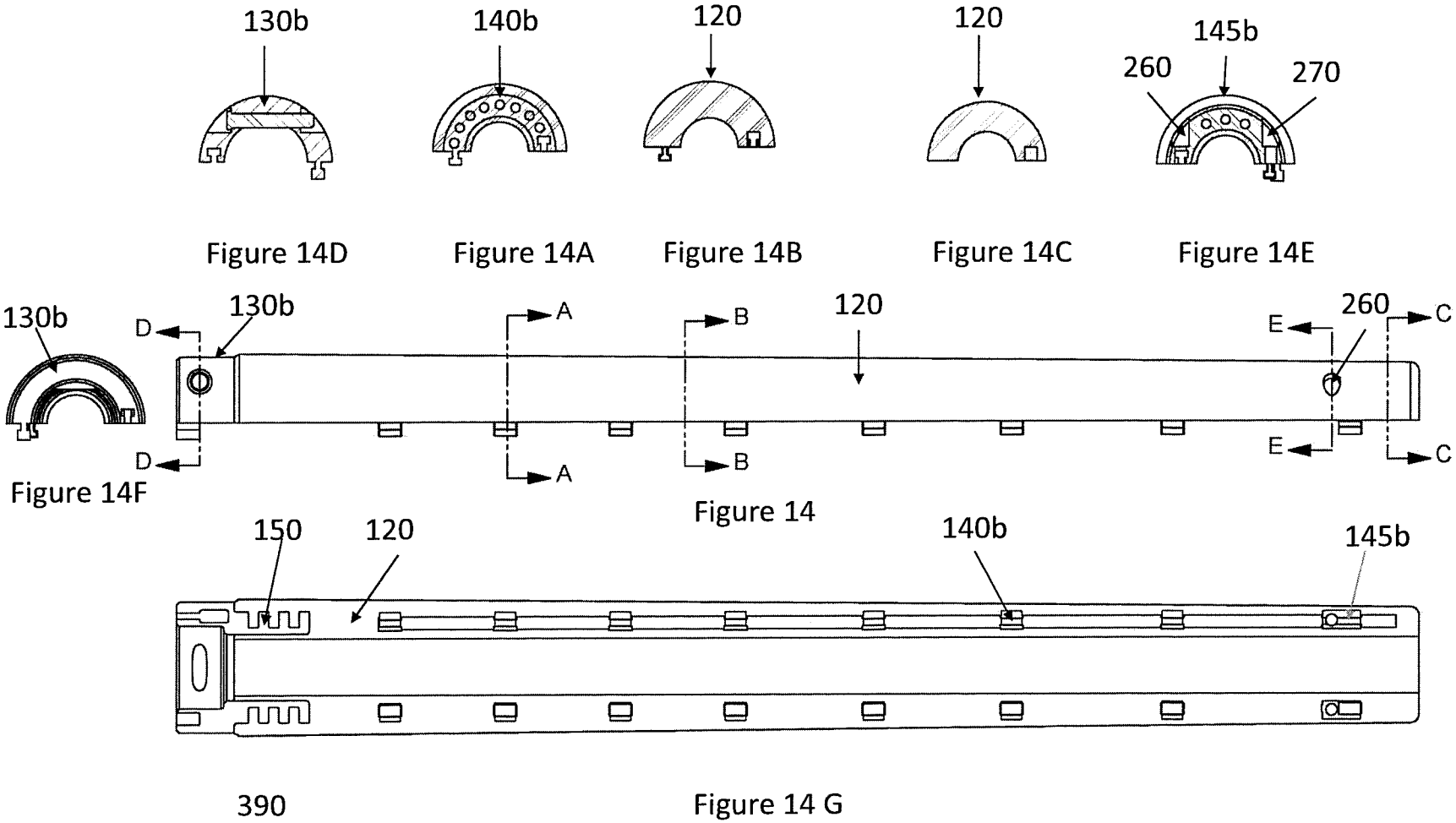
FIG. 14 is a side view of the second elongated BSR member of FIG. 13A.
FIG. 14A is a cross-sectional view of the BSR assembly of FIG. 14.
FIG. 14B is a cross-sectional view of the BSR assembly of FIG. 14.
FIG. 14C is a cross-sectional view of the BSR assembly of FIG. 14.
FIG. 14D is a cross-sectional view of the BSR assembly of FIG. 14.
FIG. 14E is a cross-sectional view of the BSR assembly of FIG. 14.
FIG. 14F is an end view of the BSR assembly of FIG. 14.
FIG. 14G is a bottom view of the BSR assembly of FIG. 14.

FIGS. 14-14E illustrate comprehensive cross sectional portions of the second elongated BSR member 120. FIG. 14 shows a BSR member that includes eight (8) support members 140*b* and includes a distal support member 145*b*. In this embodiment, the distal support member 145*b* includes the first and second keyways 260, 270 that are configured to align with a corresponding keyway of a corresponding distal support member 145*a* such that the combined keyways extend from opposing outer surfaces 190 of each BSR member 110, 120. A fastener or pin can be received within each keyway to prevent disengagement of the first elongated BSR member 110 to the second elongated BSR member 120. In this embodiment, the first and second keyways 260, 270 are axially spaced from protrusion members 220 and protrusion receiving members 230. Alternatively, keyways such as 260, 270 may be integrated into multiple protrusion/protrusion receiving members 220, 230 for added strength.

FIG. 14G illustrates the attachment between the second elongated BSR member 120 and the coupler 130. More particularly, the second coupler member 130*b* shares an interface surface 150 with the second elongated BSR member 120. The interface surface 150 includes a contoured portion of an outer surface of the second coupler 130*b* that is adapted to abut a contoured inner surface portion 390 of the second BSR member 120. The contoured inner surface portion 390 can have a profile shape that is in continuous contact with the interface surface 150 of the coupler (FIG. 14G). Optionally, the contoured inner surface 390 can include a profile shape with interrupted contact to the interface surface 150 that creates a labyrinth seal 400 with the coupler 130 (FIG. 11). The coupler members 130*a*, 130*b* are connected to one another in a similar fashion as the first and second elongated BSR members 110, 120. Each coupler member includes a protrusion member 350 and a corresponding protrusion receiving member 360 that are slidably attached to one another. Additionally, the coupler 130 can include fastener receiving openings 370 that receive a respective fastener 375 to attach the coupler 130 to the sleeve member 330 along the cable. Additionally, it is contemplated that various fastening arrangements may be employed.

FIGS. 15A through 15F illustrate schematic views of a layout of the axially spaced, arched support members 140 (now illustrated with reference numbers 410*a*-410*f*) with at least one elongated stiffness member 420. The elongated stiffness member 420 can be stranded nylon rope, helical rods, spring steel threaded rods, wire or other type of material that is received or threaded through the apertures 300 of various arched support members 410 in various configurations. Materials that are contemplated include synthetic polymers such as nylon with high elongation and strength properties or ultra-high-molecular-weight polyethylene (UHMWPE) such as Dyneema®, which exhibits some elongation and high strength typically approximately three to four times that of steel. Of course this does not preclude other materials that provide one or more of these same benefits, but are merely described herein as preferred materials.

As previously discussed, the body of the BSR members 110, 120 can be made from an elastomer material, for example a polyurethane material or a polyurethane material with strengthening material such as carbon fibers or the like. This material is not illustrated in FIGS. 15A-15F, 18-29*b* for ease of illustration; however, the stiffness members are preferably embedded in the elastomer or polyurethane material and anchored at various locations therein. The elongated stiffness members 420 are contemplated to be optionally used in either or both BSR members 110, 120 and can be threaded in various patterns through various ones of the support members 140*a*, 140*b*. For ease of illustration, FIGS. 15A-15F will identify commonly identified items with "a, b, c, d, e, f" designations. As such, FIGS. 15A-15F illustrate BSR members 110*a*-110*f*, support members 410*a*-410*f*, apertures 300*a*-300*f*, elongated stiffness members 420*a*-420*f*, proximal support members 430*a*-430*f*, and distal support members 440*a*-440*f*, respectively. Notably the proximal support members 430*a*-430*f* exist along the BSR member 110*a*-110*f* that is nearest to the coupler 130 of the BSR assembly 100. The distal support members 440*a*-440*f* are located at the distal end 180 of the BSR assembly 100 and may optionally include a keyway (not shown) as described above. Additionally, the distal support members 440*a*-440*f* are illustrated with five (5) apertures 300*a*-300*f* while the support members 410*a*-410*f* and proximal support members 430*a*-430*f* are illustrated to include eight (8) apertures 300*a*-300*f*. The size, amount and location of the apertures can of course be varied to accommodate various configurations of the elongated stiffness members to provide a stiffness strength that is desired by the BSR assembly, and should not be deemed to limit the scope and intent of the present disclosure.

The elongated stiffness members 420*a*-420*f* can include termination points 450*a*-450*f* adjacent the apertures 300*a*-300*f* of a desired support member 410*a*-410*f*, distal support member 440*a*-440*f*, or proximal support member 430*a*-430*f* to prevent the elongated stiffness member from becoming disengaged from the support member. The termination point can be a simple structure such as a knot, or a separate conventional fastener such as a nut or compression fitting, or still another structure or arrangement that secures the elongated stiffness member(s) to one or more of the support members. The termination point can be adjusted by essentially varying the length of the elongated stiffness member between the support members to modify the bending strength and displacement of the BSR assembly in a desired manner.

Figure 15A:
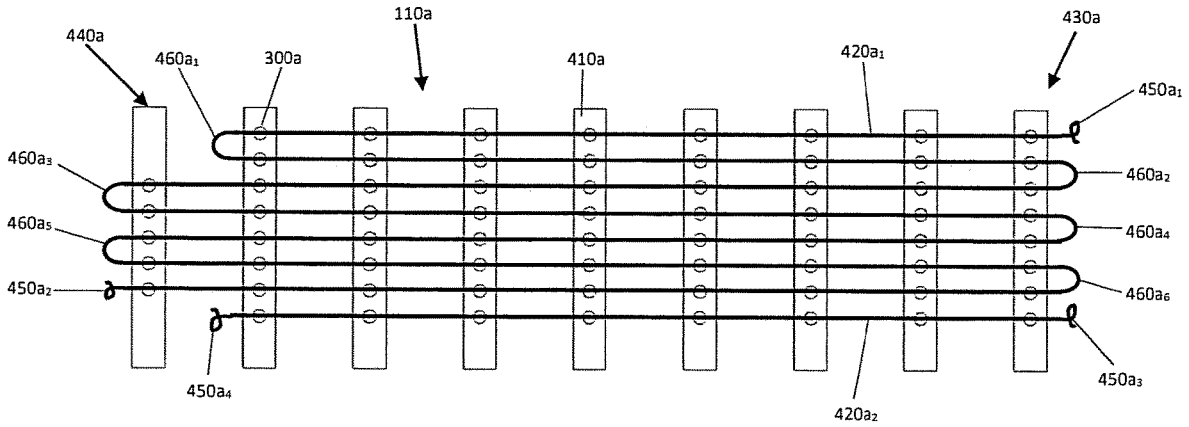
FIG. 15A is a schematic plan view of a first embodiment of the rigid support members of the BSR member with at least one elongated stiffness member.

FIG. 15A illustrates a first embodiment of the rigid support members 410*a* with a first, longer elongated stiffness member 420$a_1$ and a second, shorter elongated stiffness member 420$a_2$. The first and second elongated stiffness members 420$a_1$, 420$a_2$ are made of a stranded nylon rope that can be braided or twisted material. In this embodiment the elongated stiffness members 420$a_1$, 420$a_2$ are about ⅜" diameter rope and together equal approximately 32 feet in length, although these dimensions are exemplary only and the dimensions may be varied without departing from the scope and intent of the present disclosure. The first elongated stiffness member 420$a_1$ includes a first termination point 450$a_1$ at the proximal support member 430*a* and is threaded through a plurality of substantially axially aligned apertures 300*a* of the plurality of support members 410*a* aligned thereon. The first elongated stiffness member 420$a_1$ includes a turn 460$a_1$ adjacent the aperture 300*a* of the support member 410*a* located adjacent distal support member 440*a* and is threaded through the plurality of axial aligned apertures 300*a* of the plurality of support members 410*a* positioned thereon. A second turn 460$a_2$ is adjacent the aperture 300*a* along the proximal support member 430*a* and the first elongated stiffness member 420$a_1$ is threaded through a separate plurality of axially aligned apertures 300*a* positioned thereon to a third turn 460$a_3$ adjacent the aperture 300*a* of the distal support member 440*a*. The first elongated stiffness member 420$a_1$ is threaded through the plurality of axially aligned apertures 300*a* back to the proximal support member 430*a*. In a similar manner, turns 460$a_4$ and 460$a_6$ are adjacent the proximal support member 430*a* and turn 460$a_5$ is adjacent the distal support member 440*a* to define a generally serpentine path of the stiffness member through the apertures in the multiple support members. The first elongated stiffness member 420$a_1$ also includes a second termination point 450$a_2$ adjacent the distal support member 440*a*.

The second elongated stiffness member 420$a_2$ is threaded through the plurality of axially aligned apertures 300*a* and includes a first termination point 450$a_3$ adjacent to the aperture of the proximal support member 430*a* and a second termination point 450$a_4$ at the aperture of the support member 410*a* that is located adjacent to the distal support member 440*a*.

Figure 15B:
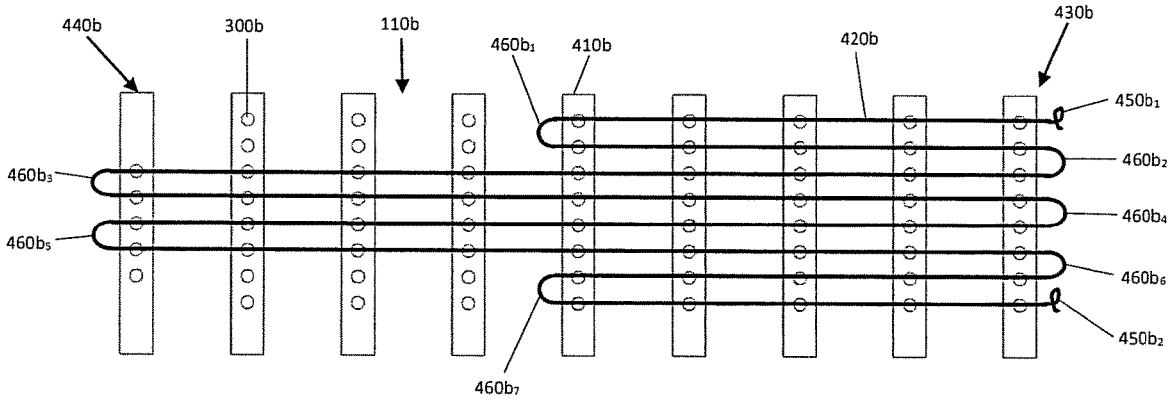
FIG. 15B is a schematic plan view of a second embodiment of the rigid support members of the BSR member with an elongated stiffness member.

FIG. 15B is a schematic plan view of a second embodiment of the rigid support members 410*c* of the BSR member 110*c* with an elongated stiffness member 420*b*. In this embodiment, only one stiffness member is utilized and is threaded through the plurality of axially aligned apertures 300*b* and includes turns 460$b_1$-460$b_7$ and termination points 450$a_1$ and 450$a_2$ positioned along the proximal support member 430*b*. Turns 460$b_1$ and 460$b_7$ are aligned along the support member 410*b* that is located approximately three support members inwardly from the distal support member 440*b*. Turns 460$b_1$ and 460$b_7$ are the outermost turns while turns 460$b_2$, 460$b_4$ and 460$b_6$ are located along the proximal support member 430*b* while turns 460$b_3$ and 460$b_5$ are located along the distal support member 440*b* and are inwardly positioned thereon. Thus, the stiffness member extends through only some of the axially aligned openings of the multiple support member along some segments of the serpentine path and extends through all of the axially aligned openings of all of the multiple support members along other segments of the serpentine path.

Figure 15C:
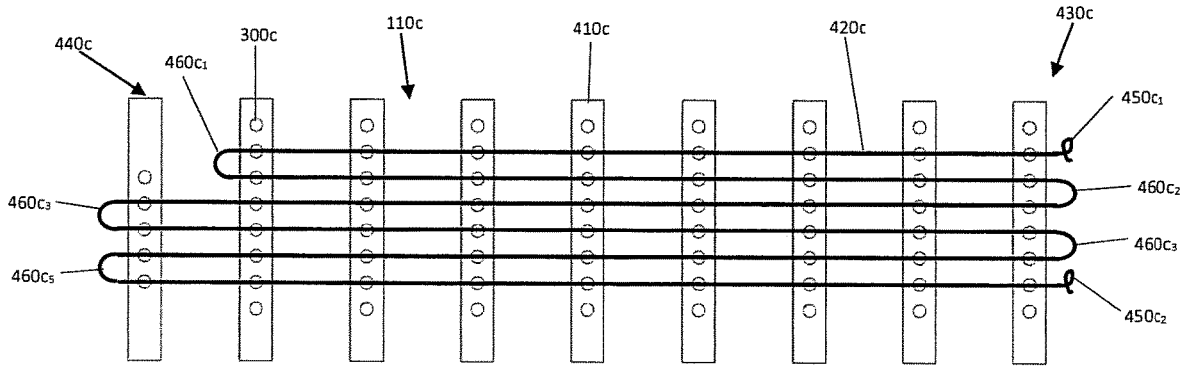
FIG. 15C is a schematic plan view of a third embodiment of the rigid support members of the BSR member with one elongated stiffness member.

FIG. 15C is a schematic plan view of a third embodiment of the rigid support members 410*c* of the BSR member 110*c* with an elongated stiffness member 420*c* made of nylon material. In this embodiment, only one stiffness member 420 is used and is threaded through the plurality of axially aligned apertures 300*c* and includes turns 460$c_1$-460$c_5$ and termination points 450$c_1$ and 450$c_2$ along the proximal support member 430*c*. Turn 460$c_1$ is aligned along the support member 410*c* that is located approximately one (1) support member inwardly from the distal support member 440*c*. Turns 460$c_1$ and 460$c_5$ are the outermost turns while turns 460$c_2$, and 460$c_4$ are located along the proximal support member 430*c* and turn 460$c_5$ is located along the distal support member 440*c*. The outermost plurality of axially aligned apertures 300*c* remains vacant as elongated stiffness member 420*c* is threaded through the apertures positioned circumferentially inwardly therefrom.

Figure 15D:
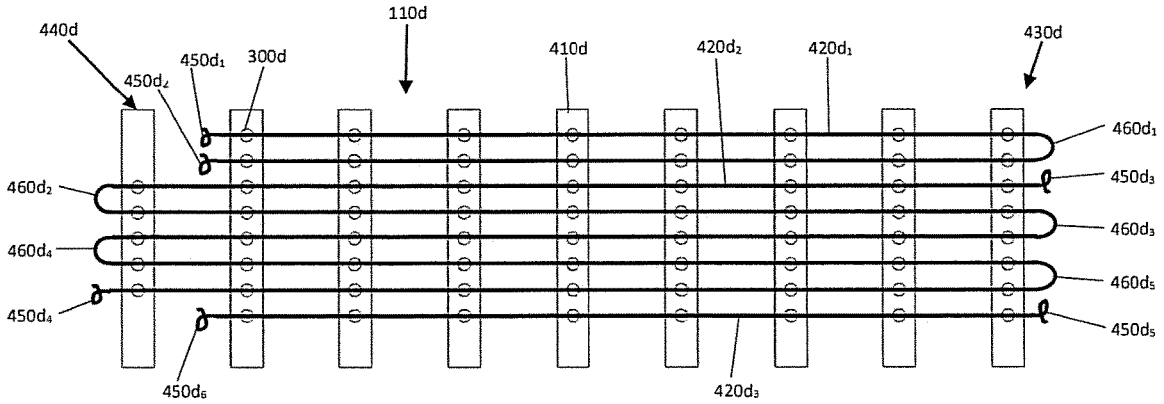
FIG. 15D is a schematic plan view of a fourth embodiment of the rigid support members of the BSR member with a plurality of elongated stiffness members.

FIG. 15D is a schematic plan view of a fourth embodiment of the rigid support members 410*d* of the BSR member 110*d* with a plurality of elongated stiffness members 420$d_1$, 420$d_2$ and 420$d_3$ in yet another pattern. In this embodiment, three (3) nylon rope stiffness members 420$d_1$, 420$d_2$ and 420$d_3$ are threaded through the plurality of axially aligned apertures 300*d* of support members 410*d* and includes turns 460$d_1$-460$d_5$ and termination points 450$d_1$-450$d_6$. Termination points 450$d_1$ and 450$d_2$ are associated with elongated stiffness member 420$d_1$ and are aligned along the support member 410*d* that is located approximately one support member inwardly from the distal support member 440*d*. Turn 460$d_1$ is associated with elongated stiffness member 420$d_1$ and is the outermost turn located along the proximal support member 430*d*. Elongated stiffness member 420$d_2$ includes four turns, for example, where turns 460$d_2$ and 460$d_4$ are located along the distal support member 440*d* while turns 460$c_3$ and 460$c_5$ are located along the proximal support member 430*d*. Termination points 450$d_3$ and 450$d_4$ are associated with elongated stiffness member 420$d_2$. Termination point 450$d_3$ is located along proximal support member 430*d* while termination point 450$d_4$ is located along distal support member 440*d*. The third elongated stiffness member 420$d_3$ includes no turns and is threaded through one of the outermost plurality of axially aligned apertures 300*d*. Termination point 450$d_5$ is positioned along the proximal support member 430*d* while termination point 450$d_4$ is positioned along the support member 410*d* that is located approximately one (1) support member inwardly from the distal support member 440*d*. Again, this particular pattern is representative of a wide array of patterns that may be used depending on the final bending characteristics that are desired or required.

Figure 15E:
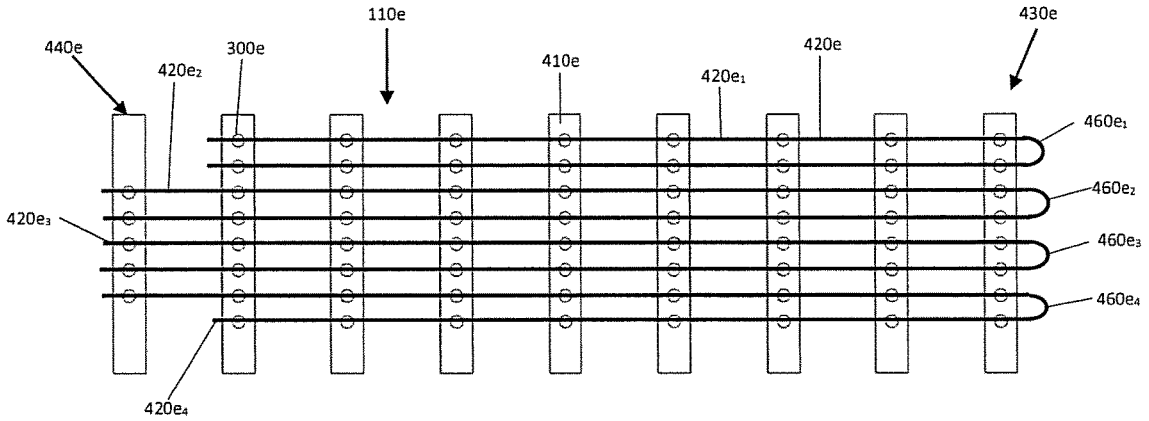
FIG. 15E is a schematic plan view of a fifth embodiment of the rigid support members of the BSR member with a plurality of elongated stiffness members.

FIG. 15E is a schematic plan view of a fifth embodiment of the rigid support members 410*e* of the BSR member 110*e* with a plurality of helical rod-type elongated stiffness members 420$e_1$, 420$e_2$ 420$e_3$ and 420$e_4$. Each of the elongated stiffness members includes two termination points and one interim turn. The turns 460$e_1$, 460$e_2$, 460$e_3$ and 460$d_4$ in this arrangement are disposed in the same manner along the proximal support member 430*e*. The elongated stiffness member 420$e_1$ is threaded through the plurality of axially aligned apertures 300*e* and terminates along the support member 410*e* that is located one support member inwardly of the distal support member 440*e*. Elongated stiffness members 420$e_2$ and 420$e_3$ are associated with turns 460$e_2$, 460$e_3$ and terminate along the distal support member 440*e*. Elongated stiffness member 420$e_4$ includes staggered terminations wherein one termination is along the distal support member 440*e* and one termination is along the support member 410*e* that is located one (1) support member inwardly from the distal support member 440*e*. Again, this arrangement shows the variations that may be used with the stiffness members.

Figure 15F:
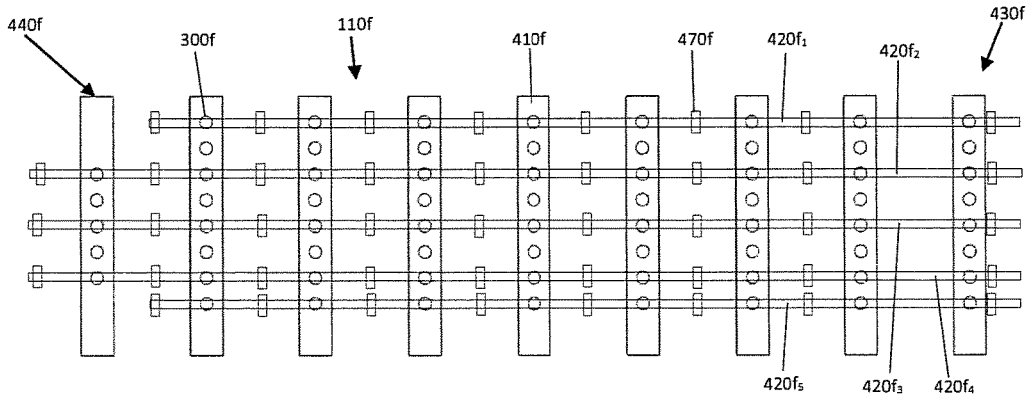
FIG. 15F is a schematic plan view of a sixth embodiment of the rigid support members of the BSR member with a plurality of elongated stiffness members with a plurality of adjustable fixed retainers and/or machine nuts positioned thereon.

FIG. 15F is a schematic plan view of a sixth embodiment of the rigid support members 410*f* of the BSR member 110*f* with a plurality of spring steel threaded rod-type elongated stiffness members 420$f_1$, 420$f_2$, 420$f_3$, 420$f_4$ and 420$f_5$ having a plurality of stop members such as threaded nuts 470*f* positioned thereon. The threaded nuts 470*f* can act as termination points along the proximal support member 430*f* and be spaced from the distal support member 440*f*. Additionally, the plurality of threaded nuts 470*f* can be spaced between the support members 410*f* at various positions to adjust the stiffness of the BSR member. As the BSR member bends, the threaded nuts abut against or lock onto the support members 410*f* to restrict further bending.

It is also contemplated that other variations may use other types of stiffness members, other patterns, and may use combinations of these different types of stiffness members in combination to achieve alternative BSR arrangements.

Figure 16A:
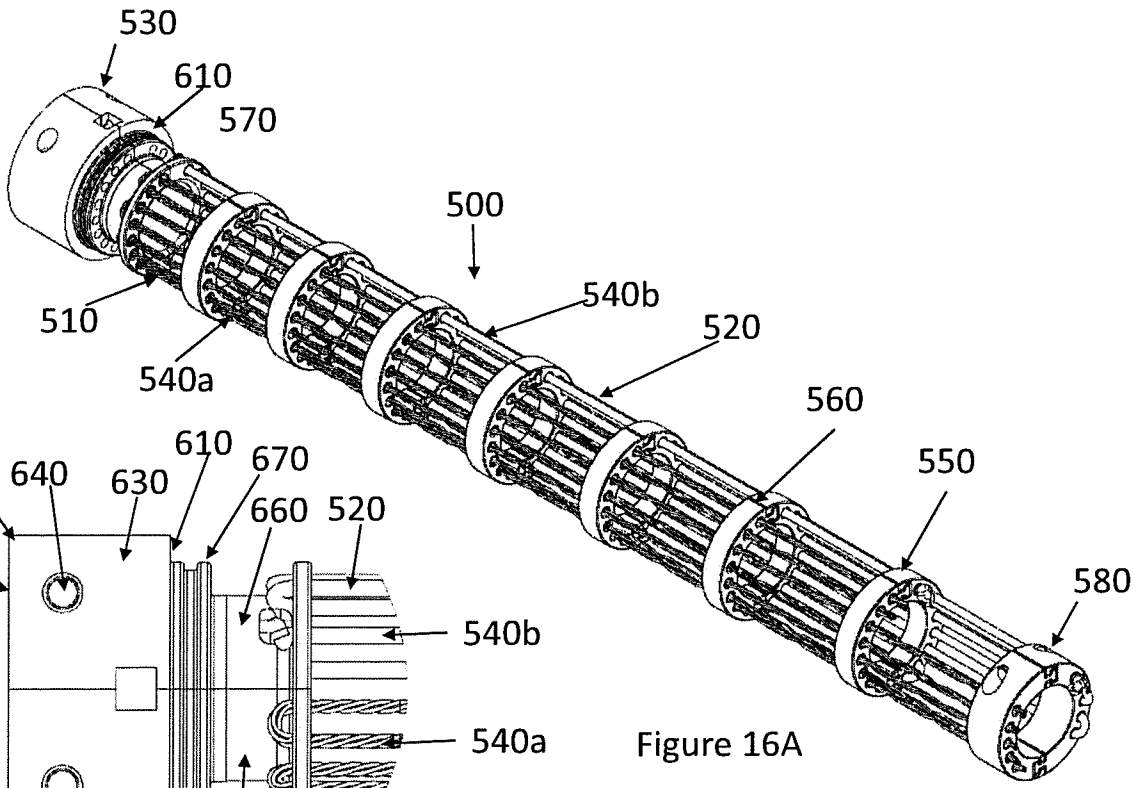
FIG. 16A is a perspective view of the BSR assembly with the plurality of elongated stiffness members.

FIGS. 16A and 17 illustrate a skeletal perspective view of another embodiment of a BSR assembly 500 with a first elongated BSR member 510 attached to a second elongated BSR member 520 and connected to a coupler 530. The coupler 530 supports the attachment of the first and second elongated BSR members 510, 520 as the BSR members are positioned along an associated elongated member such as a cable (not shown). In this embodiment, the BSR members 510, 520 include a first elongated stiffness member 540*a* and a second elongated stiffness member 540*b* that are threaded through a plurality of axially aligned apertures 550 spaced about arched shaped support members 560 and extend between a proximal support member 570 and a distal support member 580. The first elongated stiffness member 540*a* is associated with the first elongated BSR member 510 and is made, for example, of a stranded material such as nylon rope. The second elongated stiffness member 540*b* is associated with the second elongated BSR member 520 is, for example, a helical rod, spring steel threaded rod, wire or other type of material. Alternatively, the elongated stiffness members 540*a*, 540*b* can be made of the same material as illustrated in FIG. 17. These embodiments of the BSR assembly 500 are illustrated without an elastomer material that is configured to substantially cover exterior and interior surfaces of the assembly.

The elongated stiffness members 540*a*, 540*b* includes turns and termination points at various locations along the support members 560, proximal support members 570 and distal support members 580 of both the first and second elongated BSR members 510, 520. The elongated stiffness members 540*a*, 540*b* are configured in a circumferential pattern that adapts to the arched shape support members 560 as the stiffness members extend lengthwise along the BSR assembly 500.

Figure 16B:
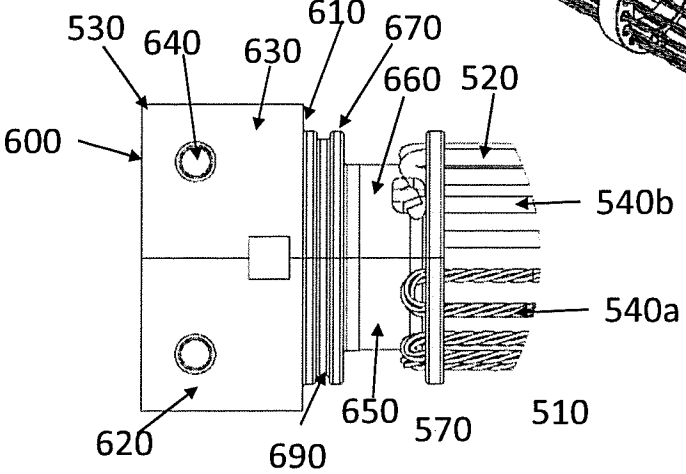
FIG. 16B is a partial enlarged plan view of the BSR assembly of FIG. 16A.
Figure 17A:
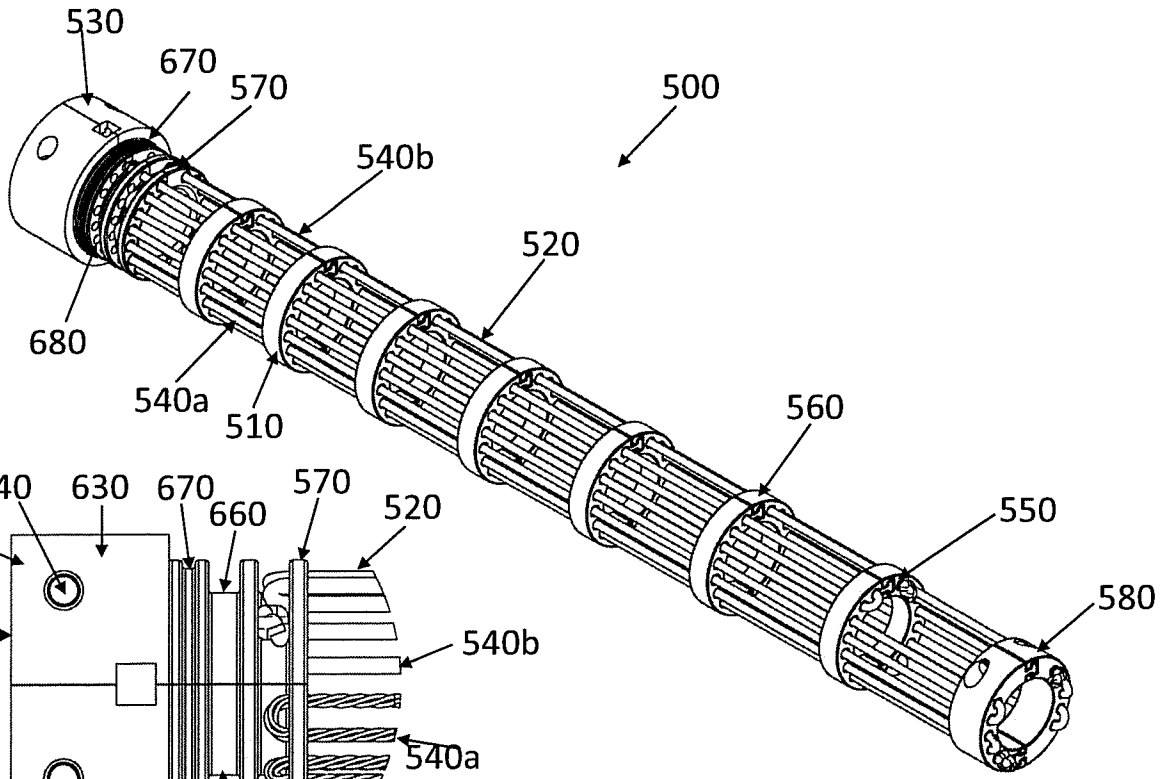
FIG. 17A is a perspective view of the BSR assembly with a plurality of elongated stiffness members.
Figure 17B:
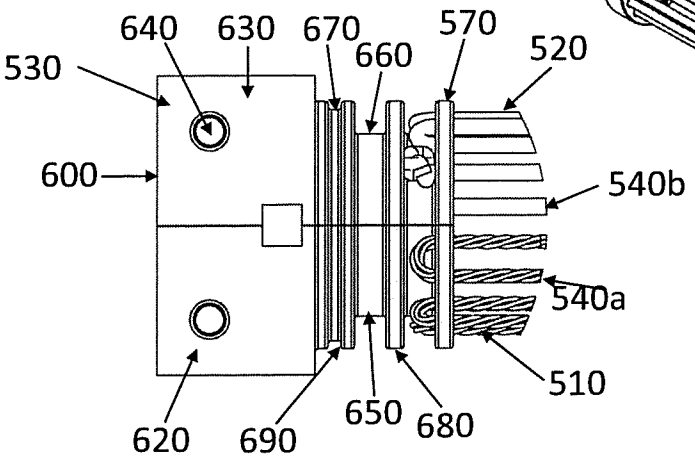
FIG. 17B is a partial enlarged plan view of the BSR assembly of FIG. 17A.

Additionally, FIGS. 16B and 17B illustrate the coupler 530 attached to the first and second BSR members 510, 520 at a proximal end thereof. The coupler 530 includes a first end 600 and an opposite, second end 610 with a longitudinal inner surface that extends from the first end to the second end. The coupler has a curved profile or inner arcuate surface that aligns with the inner arcuate surface of the BSR members. In this embodiment, the coupler 530 includes a first portion 620 that is directly attached to the first elongated BSR member 510 and a second portion 630 that is directly attached to the second elongated BSR member 520. Here, for simplicity, the first portion 620 and first extension member 650 are identical to the second portion 630 and the second extension member 660 to allow for ease of manufacturing.

The coupler 530 includes a fastener aperture 640 dimensioned to receive a conventional fastener or pin to axially lock BSR member 510, 520 relative to the housing flange member 330*c*, 330*d* (FIG. 10). First and second extension members 650, 660 are provided to attach the first and second portions 620, 630 to the proximal support members 570, respectively. The first and second extension members 650, 660 include a radial base 670 that abuts against the second side 610 of the coupler 630. Further, the radial base 670 preferably has a smaller radial profile dimension than the coupler 530 and can define an annular groove 690.

Additionally, as illustrated by FIGS. 17A and 17B, the first and second extension members 650, 660 can optionally include a radial shoulder 680 that is provided between the radial base 670 and the proximal support member 570. The radial base 670 and the radial shoulder 680 are adapted to be covered by the elastomer material described above.

Figure 18:
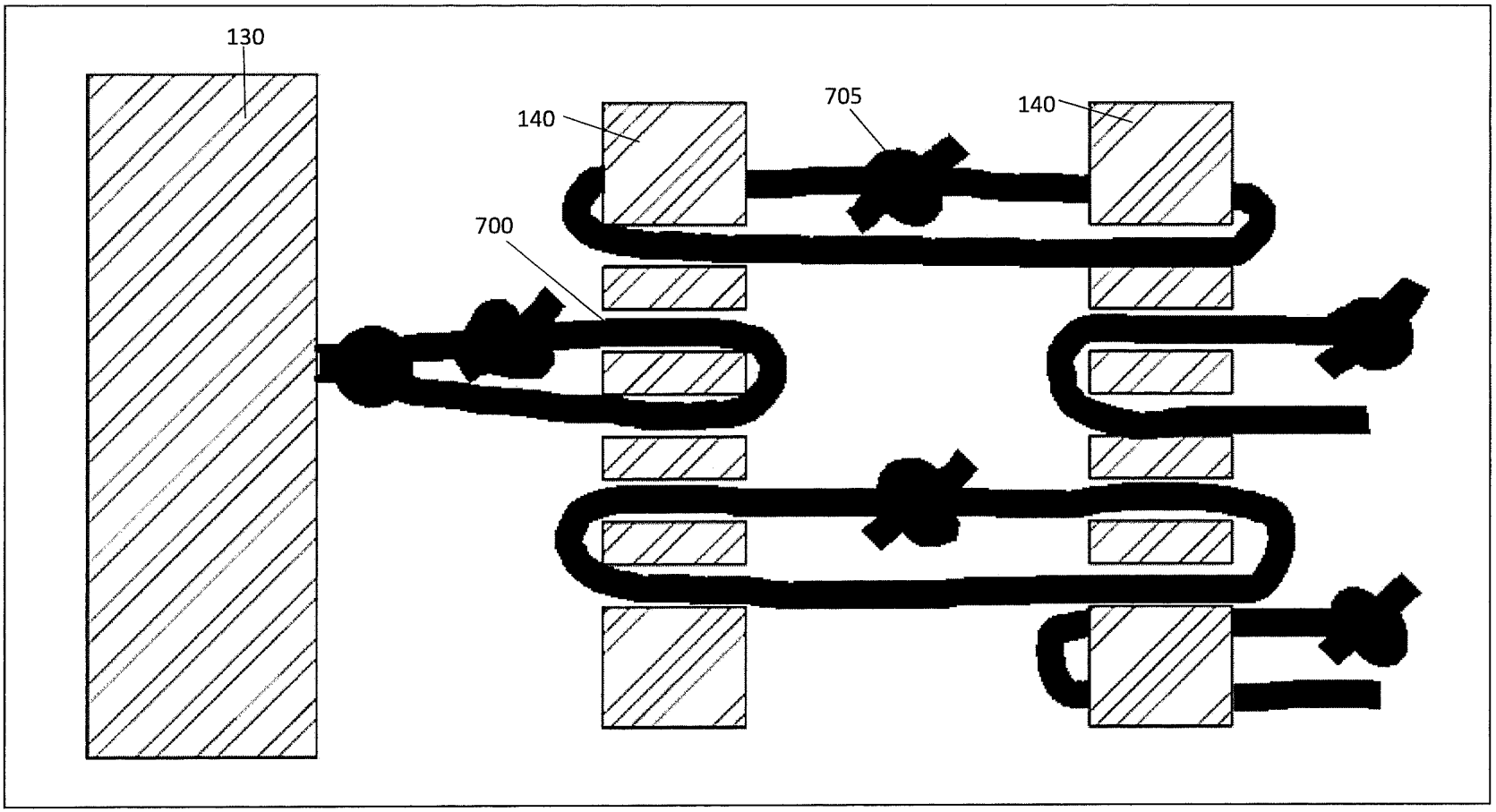
FIG. 18 is an enlarged schematic view of a portion of the BSR assembly with the plurality of elongated stiffness members as rope loops.

Embodiments disclosing various orientations of the elongated stiffness members are discussed in FIGS. 18-29*c*. Each embodiment disclosed is contemplated to be potted within a cured polyurethane material. FIG. 18 is an enlarged schematic view of a portion of the BSR assembly with the plurality of elongated stiffness members as rope loops 700. The rope loops are loosely coupled between a plurality of support members 140 that are provided at axially spaced locations along the first and second BSR members 110, 120, respectively. The rope loops 700 are terminated at the coupler 130 through an eyehole 710 or can optionally be terminated at the coupler with known conventional fasteners. The rope can be made from nylon or a polymer such as polypropylene or Dyneema® brand rope or still other conventional rope material. The rope loops 700 are threaded through apertures within the support members 140 and connected via knots or other conventional means for joining rope ends such as clips, fasteners, etc. The rope can be 3/16" diameter measurement but this disclosure is not limiting.

Figure 19:
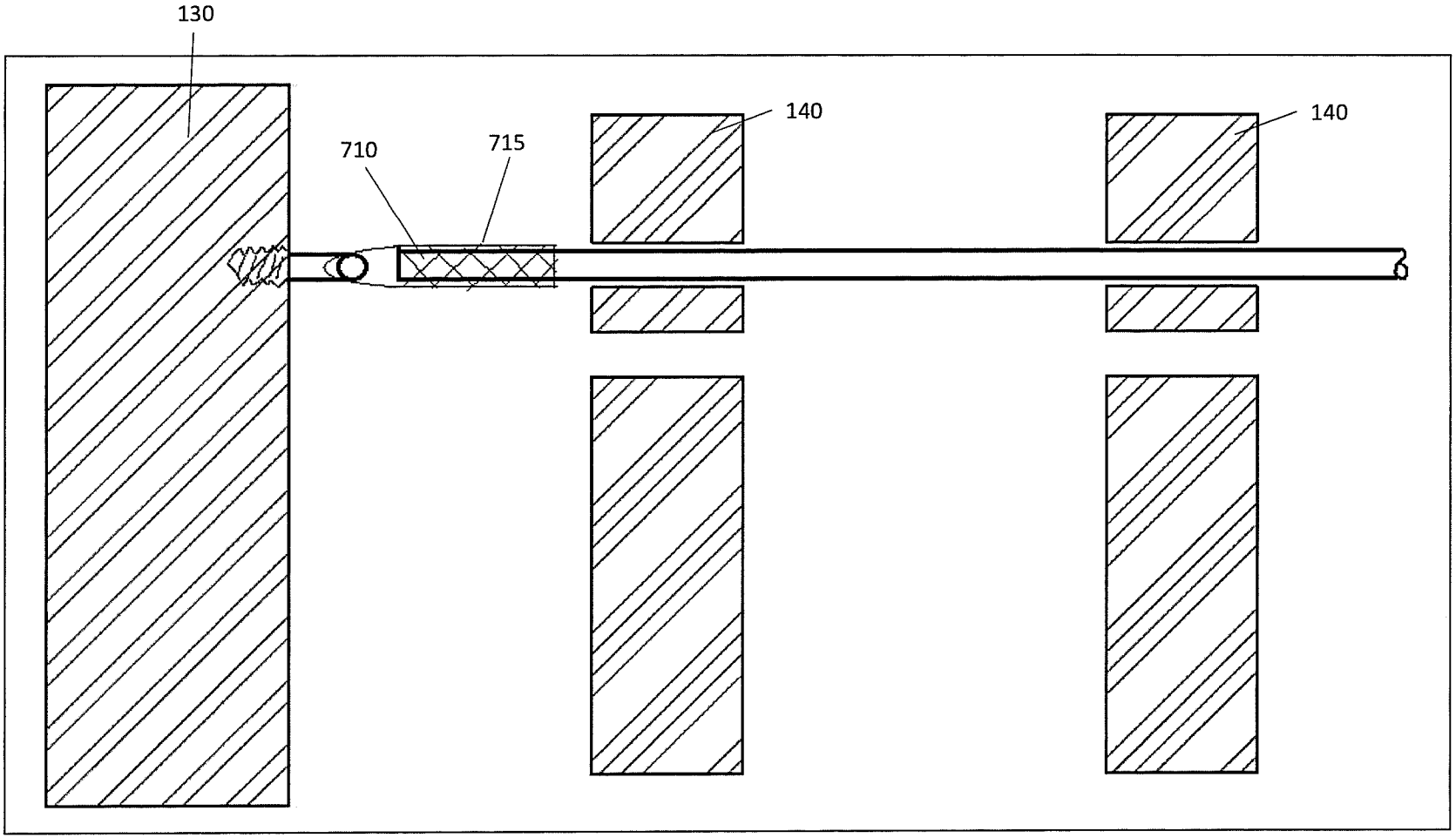
FIG. 19 is an enlarged schematic view of a portion of the BSR assembly with the plurality of elongated stiffness members as composite rods.

FIG. 19 is an enlarged schematic view of a portion of the BSR assembly with the plurality of elongated stiffness members as composite rods 710. The composite rods 710 are terminated at the coupler 130 through a conventional fastener such as a hook and screw. The rods 710 are threaded through apertures of the support members 140 and have various lengths in a generally staggered orientation. The composite rods 710 are generally a composite material such as fiberglass that are generally solid with a sand blasted surface that is primed, although other materials may be used without departing from the scope and intent of the present disclosure. The rods 710 are loosely fed through the stiffness members 140 to allow for various strengths that resist bending of the assembly. The rods can have a helical grip 715 that extends along the rod from the connection to the coupler 130 to offer additional strength at the connection point to the coupler 130. The helical grip 715 can be multiple strands of wire that are wound around the rod in various arrangements and in a manner generally known in the art of gripping or terminating cables.

Figures 20A, 20B:
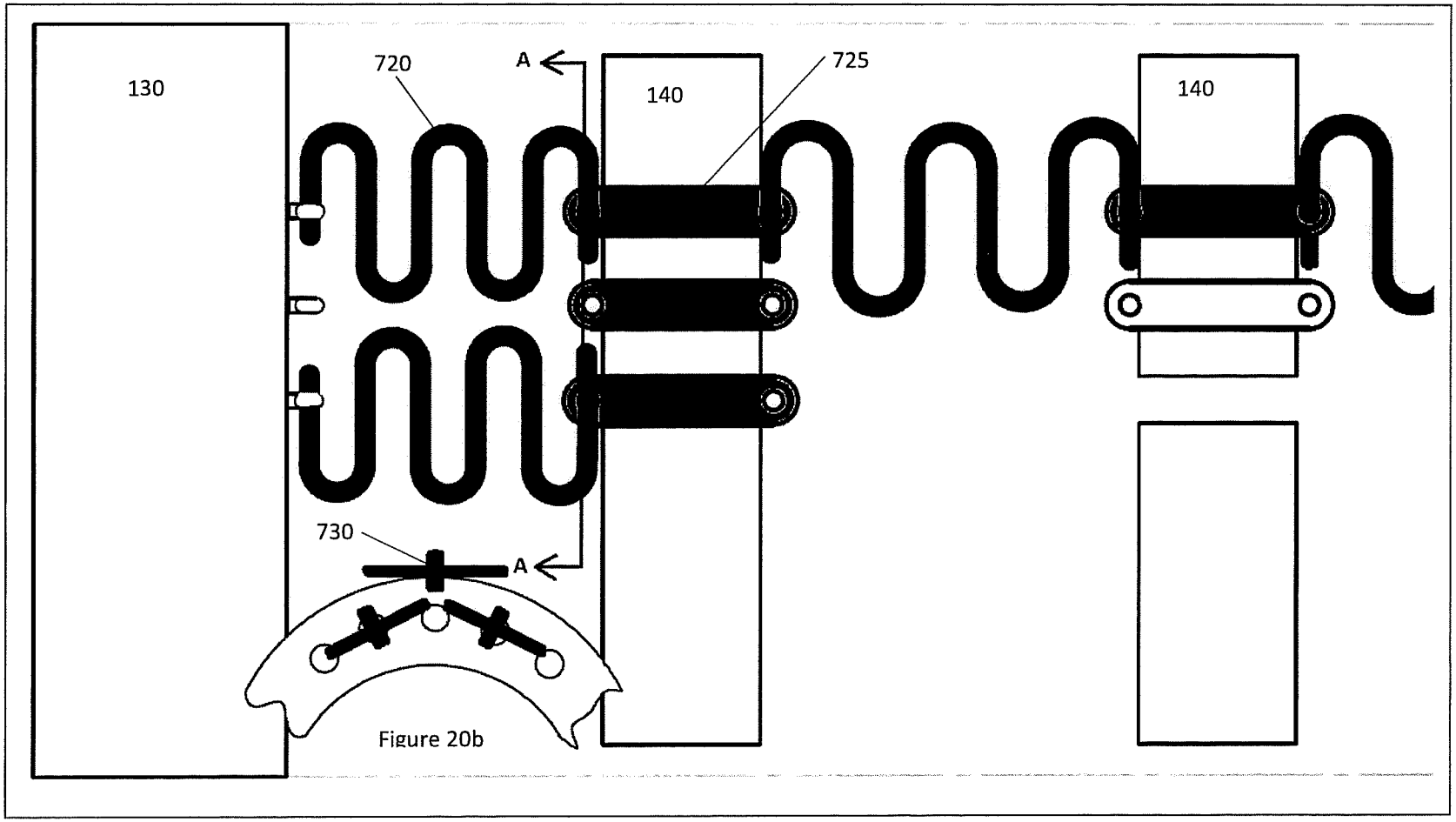
FIG. 20A is an enlarged schematic view of a portion of the BSR assembly with the plurality of elongated stiffness members as spring sections and coupling links.
FIG. 20B is a section view thereof.

FIG. 20*a* is an enlarged schematic view of a portion of the BSR assembly with the plurality of elongated stiffness members as spring sections 720 and coupling links 725. The coupling links 725 are preferably placed within apertures of the rigid support members 140 and include eye holes or similar securing structure for receiving an end of the spring sections 720 therein. The coupling links 725 are generally flat for receipt through the support member apertures with the securing structure accessible at opposite ends of the coupling links when disposed in the aperture while the spring sections 720 are a serpentine shaped wire having, for example, 0.188 gauge wire that is hardened to about 220 kpsi. The spring sections 720 can be attached to one another through the coupling links 724 and have various arrangements within the assembly. As shown, the spring sections 720 and coupling links 725 can be adapted to generally follow the C shape contour of the support members 140 (FIG. 20*b*). Additionally, there can be a second layer 730 of spring sections and coupling links that are placed over the top of the other spring sections, e.g., as seen FIG. 20*b*, two of the springs are generally angled relative to one another from an intermediate radial position, while an additional layer(s) of spring(s) can be used at a different radial location (shown here as an outer radial location).

Figure 21:
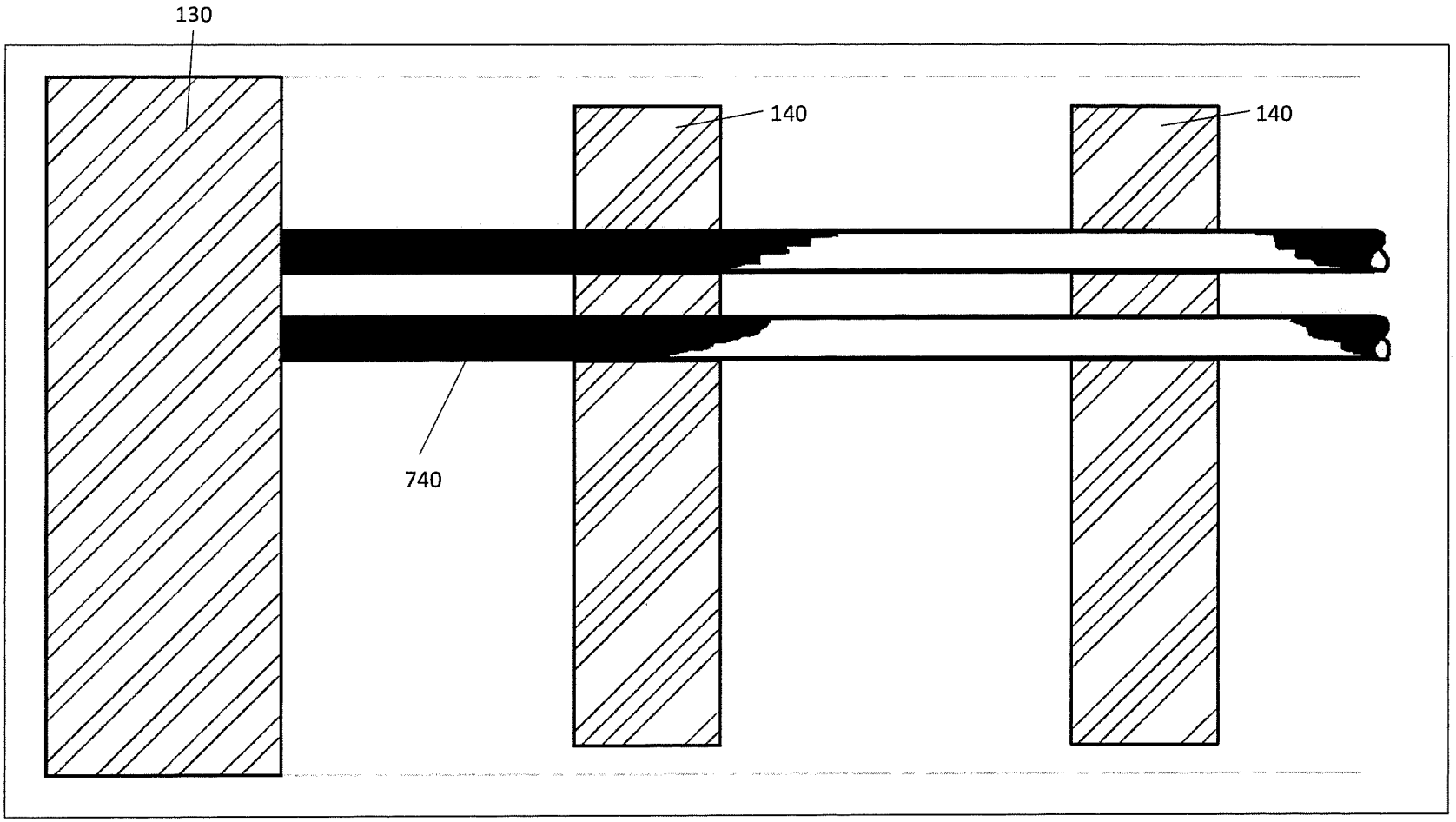
FIG. 21 is an enlarged schematic view of a portion of the BSR assembly with the plurality of elongated stiffness members as stiffness rods.

FIG. 21 is an enlarged schematic view of a portion of the BSR assembly with the plurality of elongated stiffness members as stiffness rods 740. The stiffness rods can be stiff rods made of polyurethane material or other suitably stiff material of similar or various lengths that are arranged through the rigid support members 140, for example, in staggered lengths whereby various bending capabilities can be adequately addressed. In this embodiment, the stiffness rods 740 are not anchored to the coupling 130 but are frictionally bonded to the rigid support members 140 through apertures.

Figures 22A, 22B:
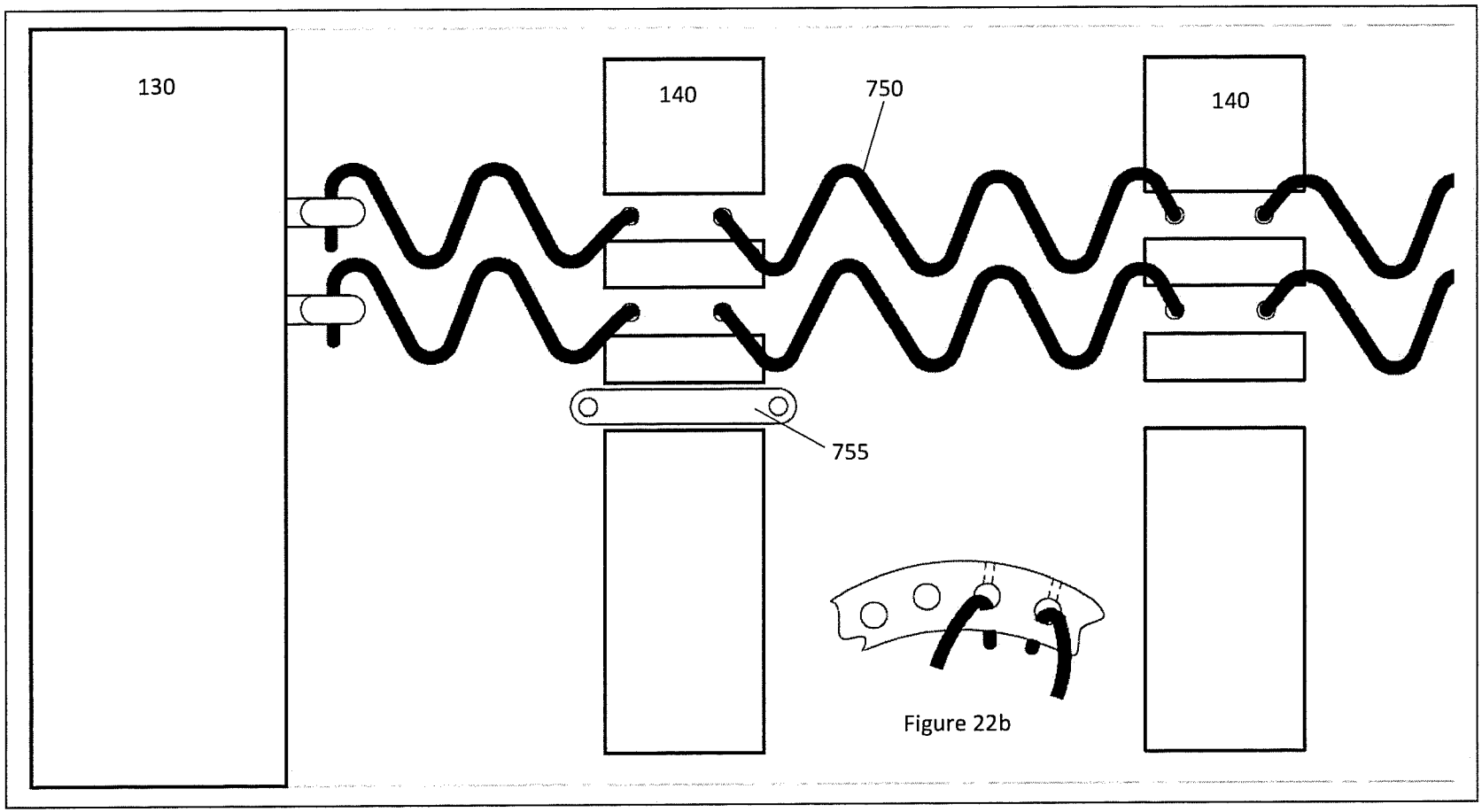
FIG. 22A is an enlarged schematic view of a portion of the BSR assembly with the plurality of elongated stiffness members as helical rods and FIG. 22B is a sectional view thereof.

FIG. 22*a* is an enlarged schematic view of a portion of the BSR assembly with the plurality of elongated stiffness members as helical rods 750. The helical rods 750 can be threaded through apertures of the support members 140 or connected to rod connectors 755. The helical rods are sand blasted and primed for bonding and include, for example, a pitch length of 1.5" with a gauge between about 0.137 to 0.188 wire although other dimensional arrangements are also contemplated. Additionally, the helical rods can include right angle termination points at the coupler 130 and/or support members 140 wherein the rods are hooked thereon by the rod bent to a right angle through an eyebolt or aperture, or fed through radially extending slots that communicate with the support member apertures (see FIG. 22*b*).

Figure 23:
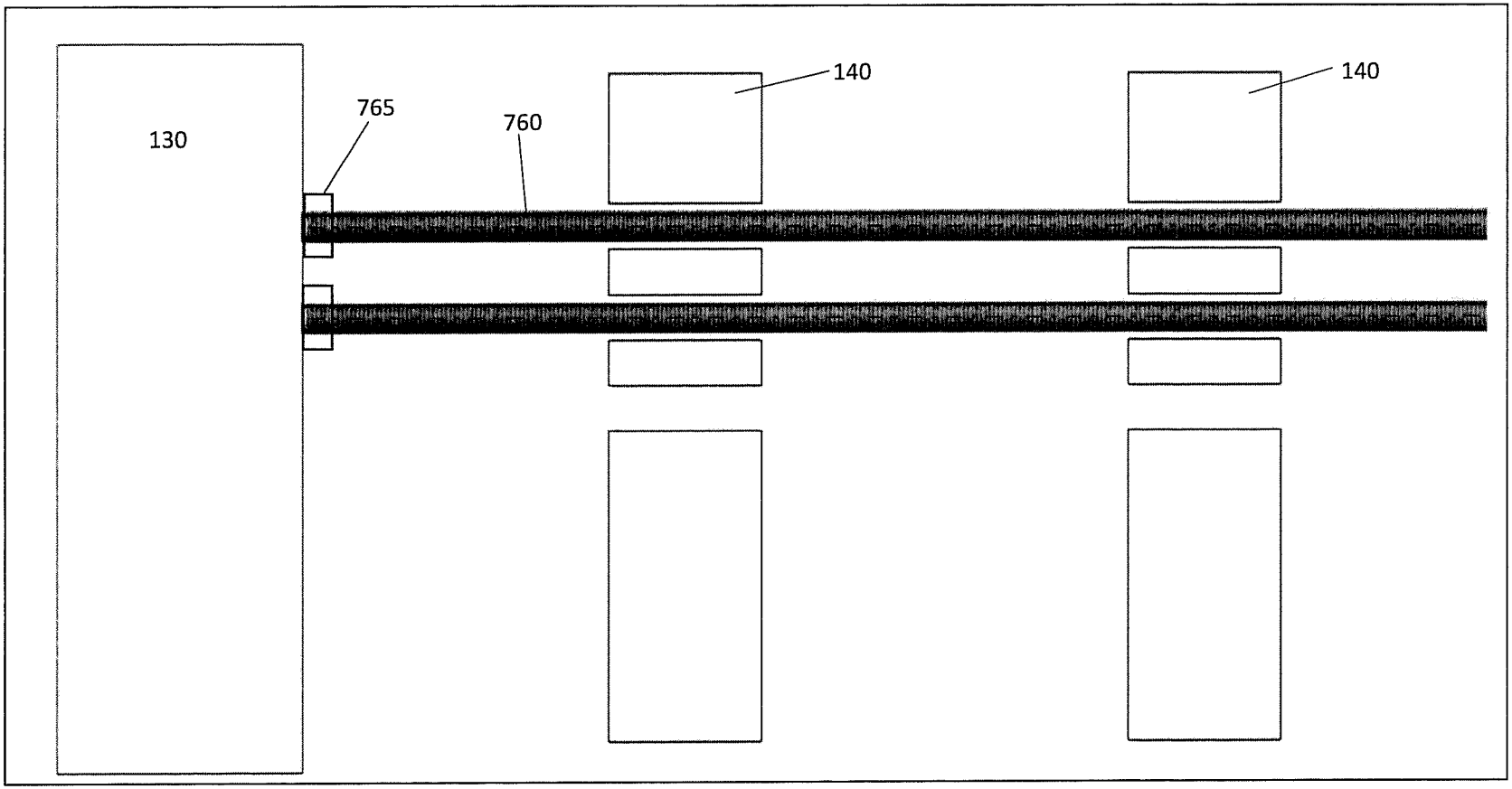
FIG. 23 is an enlarged schematic view of a portion of the BSR assembly with the plurality of elongated stiffness members as threaded rods.

FIG. 23 is an enlarged schematic view of a portion of the BSR assembly with the plurality of elongated stiffness members as threaded rods 760. The threaded rods 760 are preferably anchored to the coupler 130 (e.g., threadedly received therein) by a fastener or nut 765. In one embodiment, the rods have a 1/4" diameter made with high tensile stiffness metal, although other dimensions and materials may be used. The threaded rods 760 can have similar or varied lengths and placed in staggered orientation through the apertures of the support members 140 to address desired bending needs of the intended end use. In the illustrated arrangement, the threaded rods are dimensioned for free receipt through the support members.

Figure 24:
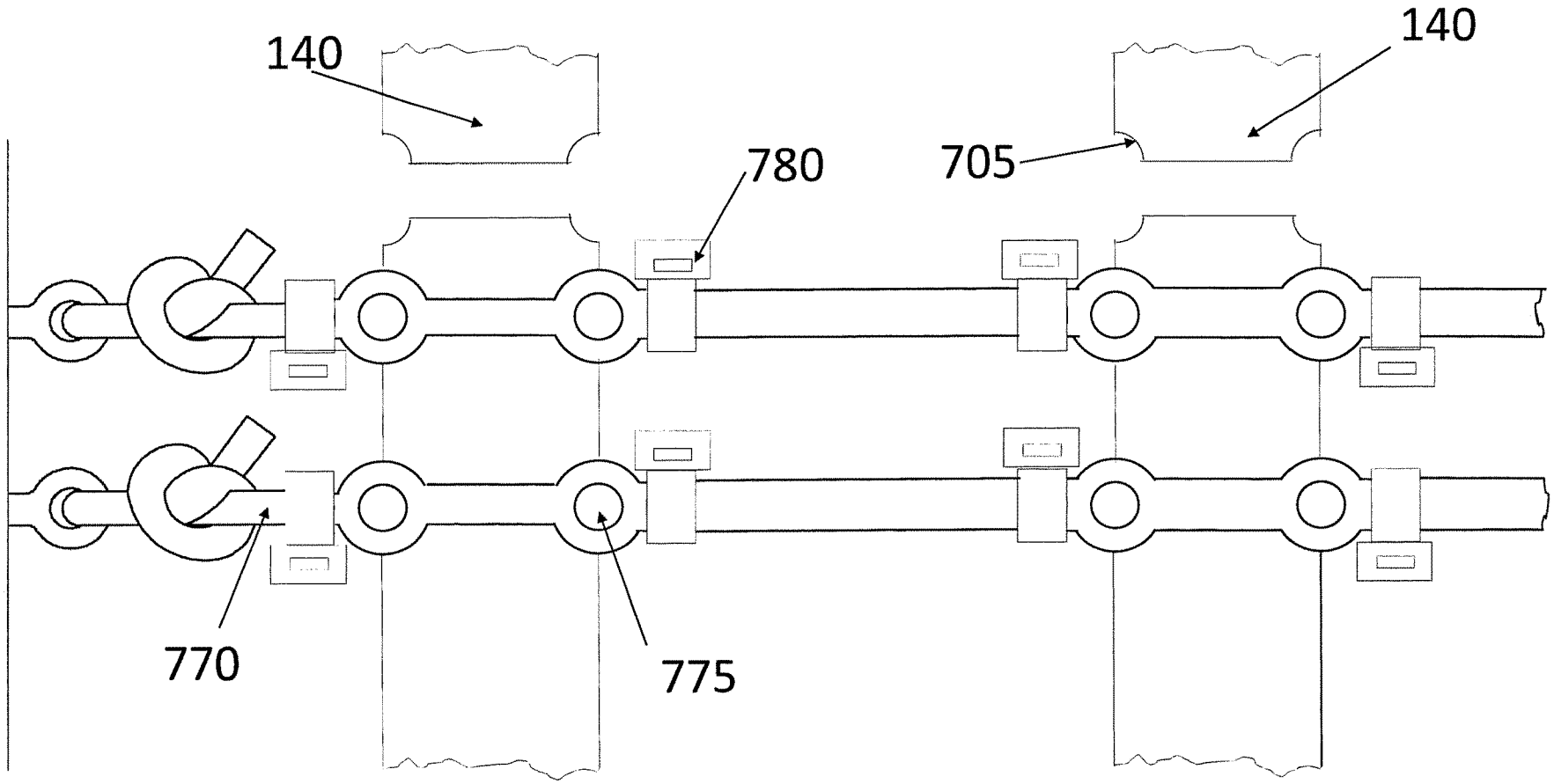
FIG. 24 is an enlarged schematic view of a portion of the BSR assembly with the plurality of elongated stiffness members as linear locked rope.

FIG. 24 is an enlarged schematic view of a portion of the BSR assembly with the plurality of elongated stiffness members as linear locked rope 770. The rope 770 can be made from 3/16" diameter Dyneema® brand material, for example, and threaded through apertures of the support members 140. Steel balls 775 and strap locks 780 such as nylon Tylok™ can be used as one example of an axial fastener or restraining assembly to restrain the rope within the support member, i.e., at opposite axial ends of the support members. The apertures of the support member preferably include a countersunk profile 785 to accommodate or receive the spherical shape of the balls 775 therein that are used as termination points to lock the rope at either side of the support member 140. This orientation preferably places the stiffness members in tension relative to the support members and can be arranged to modify the bending strength/resistance of the assembly. Likewise, the arrangement can be easily assembled on site. A knot or fastener is provided at one end to dead end or secure the rope to the metal adapter, for example through the openings in the eye bolts as illustrated.

Figure 25:
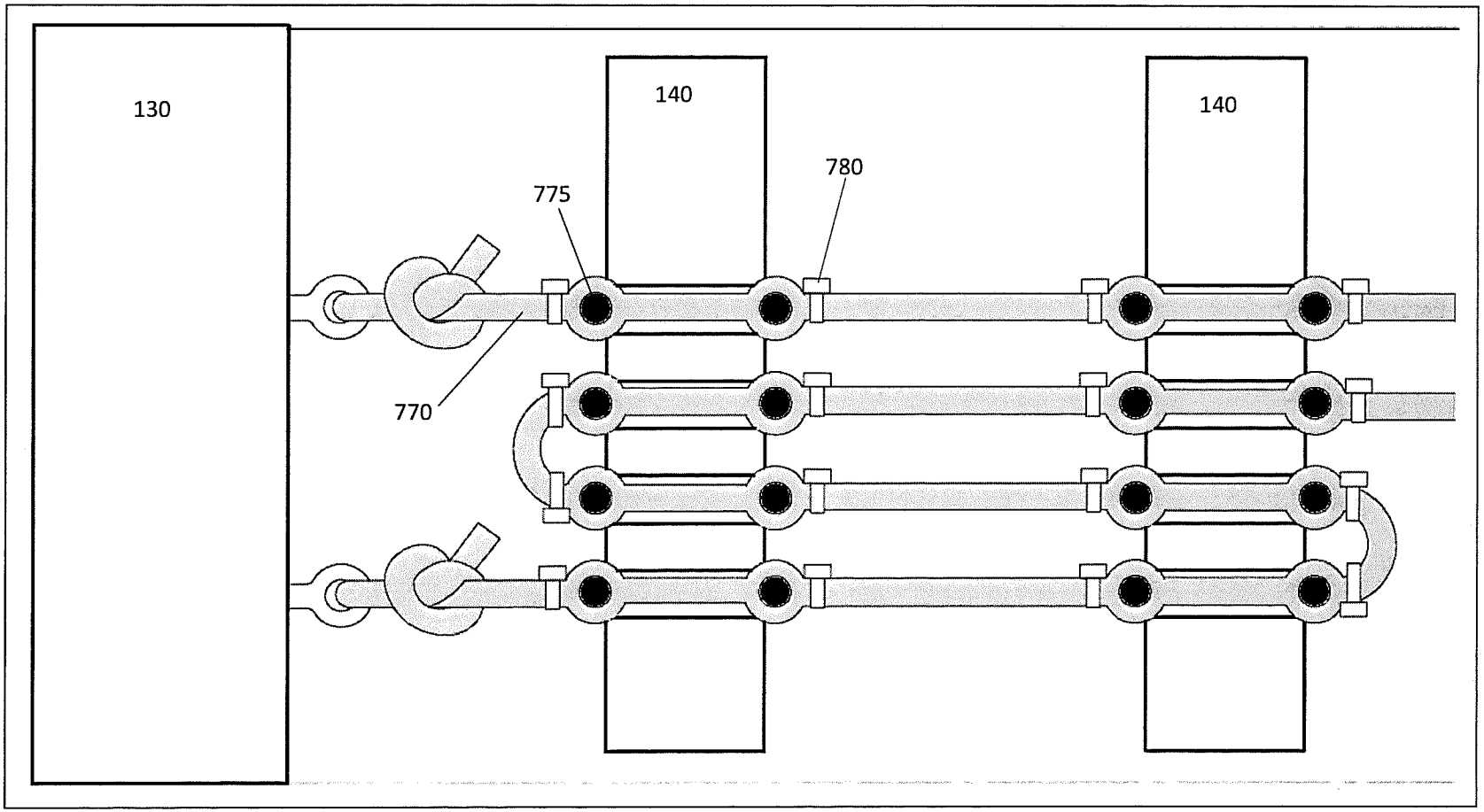
FIG. 25 is an enlarged schematic view of a portion of the BSR assembly with the plurality of elongated stiffness members as interweaved locked rope.
Figure 26:
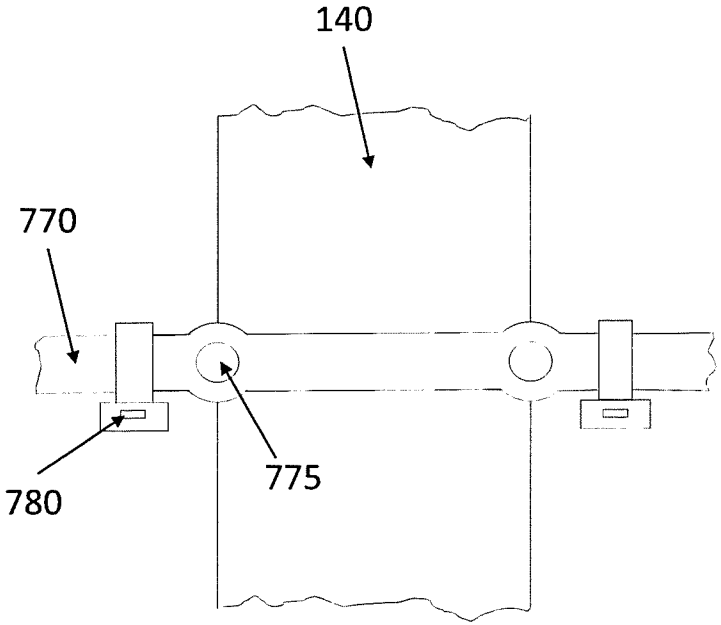
FIG. 26 is an enlarged view of the locked rope type of elongated stiffness member of FIGS. 24 and 25.

FIG. 25 is an enlarged schematic view of a portion of the BSR assembly with the plurality of elongated stiffness members having locked rope 770 threaded through various apertures of the support members 140. This arrangement contemplates various weaving patterns that include the steel ball 775 and strap lock 780 rope configurations generally described in connection with the embodiment of FIG. 24, although selected aspects of the weaving concept can be used with still other embodiments. FIG. 26 is an enlarged view of the locked rope 770 of elongated stiffness member as also illustrated by FIGS. 24 and 25.

Figure 27A:
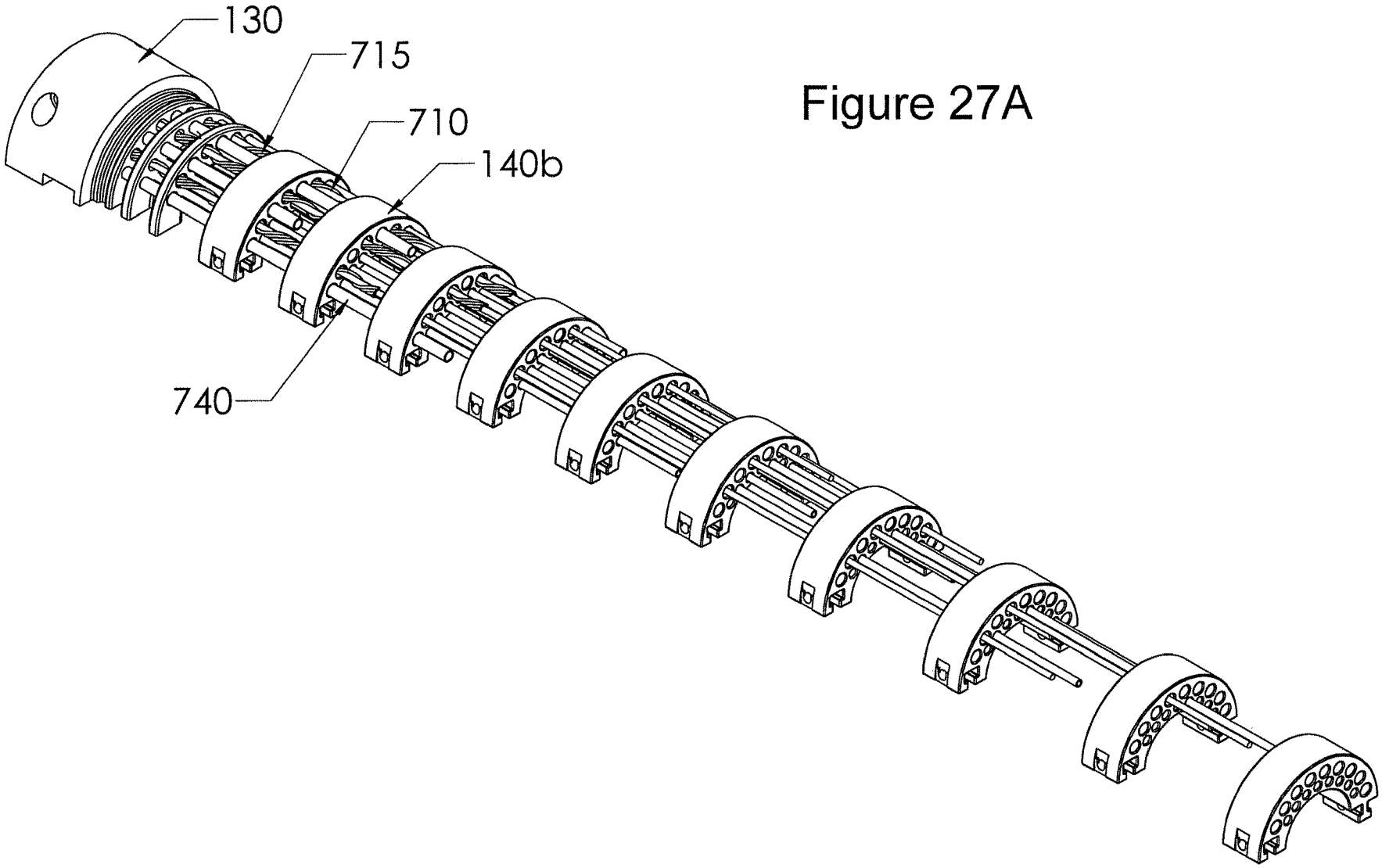
FIG. 27A is a perspective outline view of the second elongated BSR member with the plurality of rigid support members and a plurality of elongated stiffness members as composite rods as illustrated in FIG. 19 and stiffness rods as illustrated in FIG. 21.
Figure 27B:
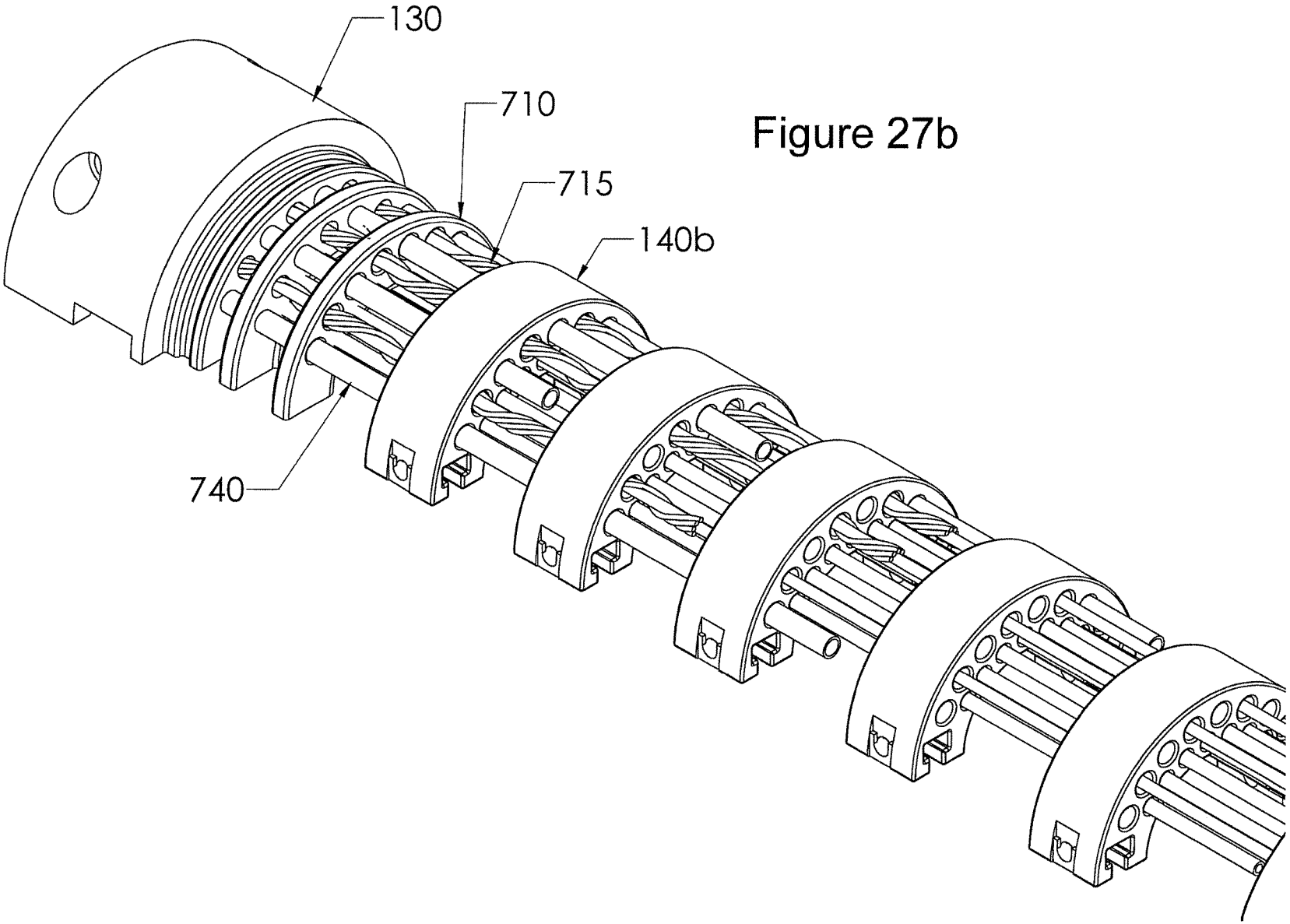
FIG. 27B is an enlarged perspective outline view of the second elongated BSR member of FIG. 27A with a plurality of elongated stiffness members as composite rods as illustrated in FIG. 19 and stiffness rods as illustrated in FIG. 21.

FIGS. 27A and 27B provide an outline view of the second elongated BSR member with the plurality of rigid support members and a plurality of elongated stiffness members shown as composite rods 710 as illustrated in FIG. 19 and stiffness rods 740 as illustrated in FIG. 21. The composite rods 710 are loosely fed through the stiffness members 140 to allow for various strengths that resist bending of the assembly. Depending on the number, placement, stiffness, etc., of the individual rods, the bending stiffness of the assembly can be suitably altered as desired. The helical grip 715 extends along the rod from the coupler 130 to offer additional strength at the connection point to the coupler 130. The helical grip 715 can be multiple strands of wire that are wound around the rod in various arrangements. The stiffness rods 740 are also provided in this embodiment illustrating that one or more of the concepts from various ones of the embodiments can be used in various combinations. The rods 740 are made of polyurethane material of various lengths that are arranged in staggered relation through the rigid support members 140. In this embodiment, the stiffness rods 740 are not anchored to the coupling 130 but are frictionally bonded to the rigid support members 140 through apertures, although in other instances, the rods may or may not be anchored.

Figure 28A:
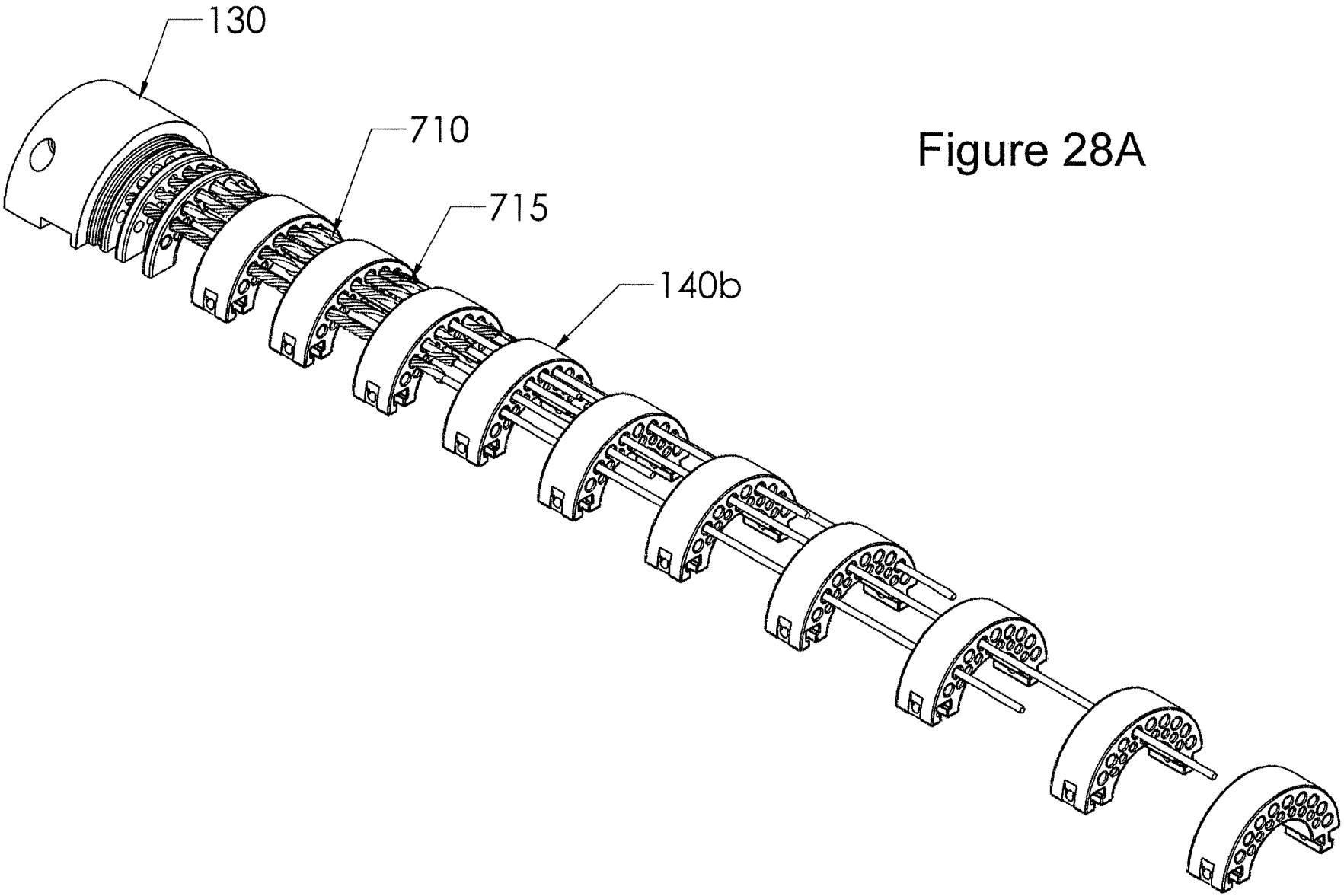
FIG. 28A is a perspective outline view of the second elongated BSR member with the plurality of rigid support members and a plurality of elongated stiffness members as composite rods as illustrated in FIG. 19.
Figure 28B:
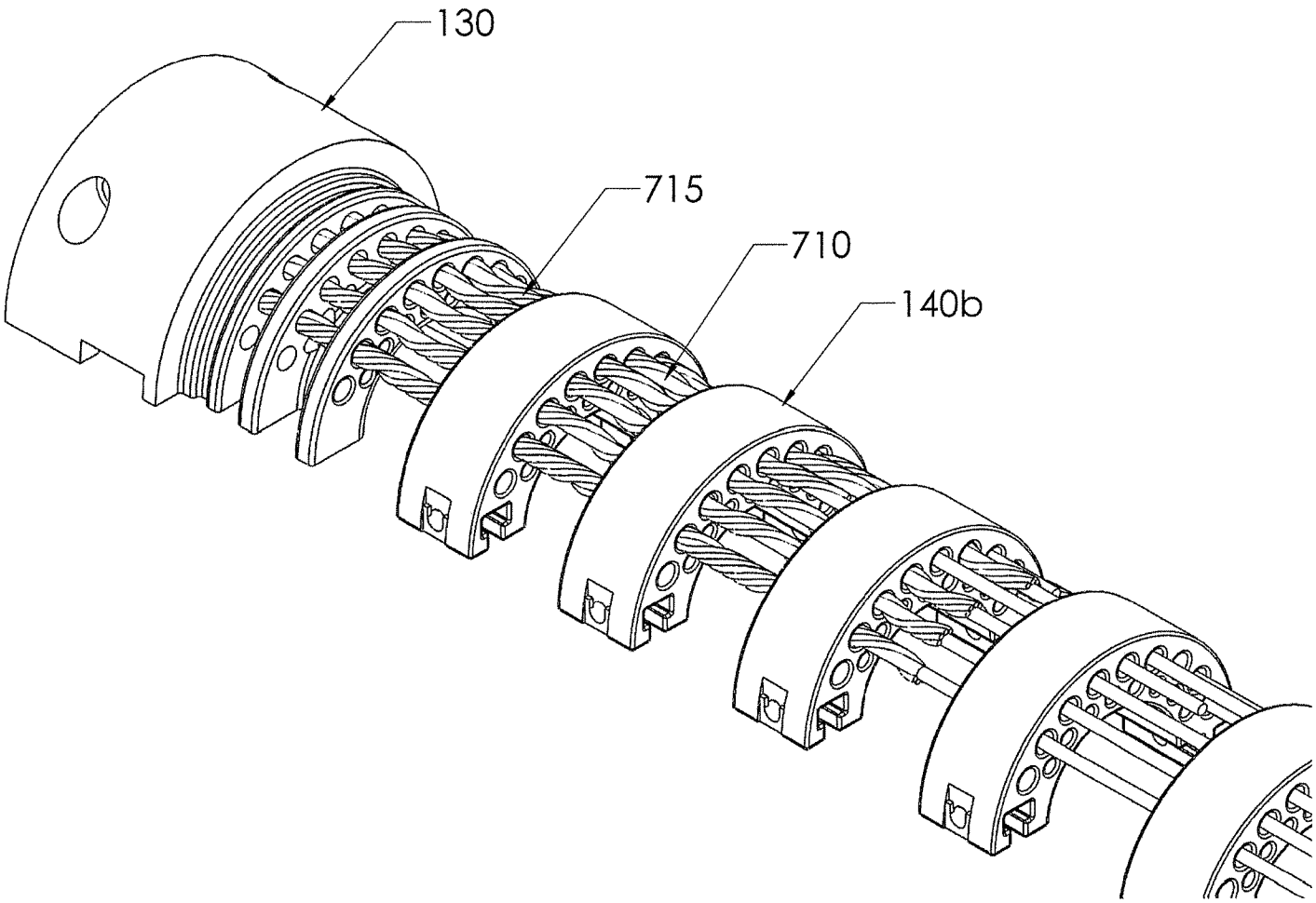
FIG. 28B is an enlarged perspective outline view of the second elongated BSR member of FIG. 28A with a plurality of elongated stiffness members as composite rods as illustrated in FIG. 19.
Figure 28C:
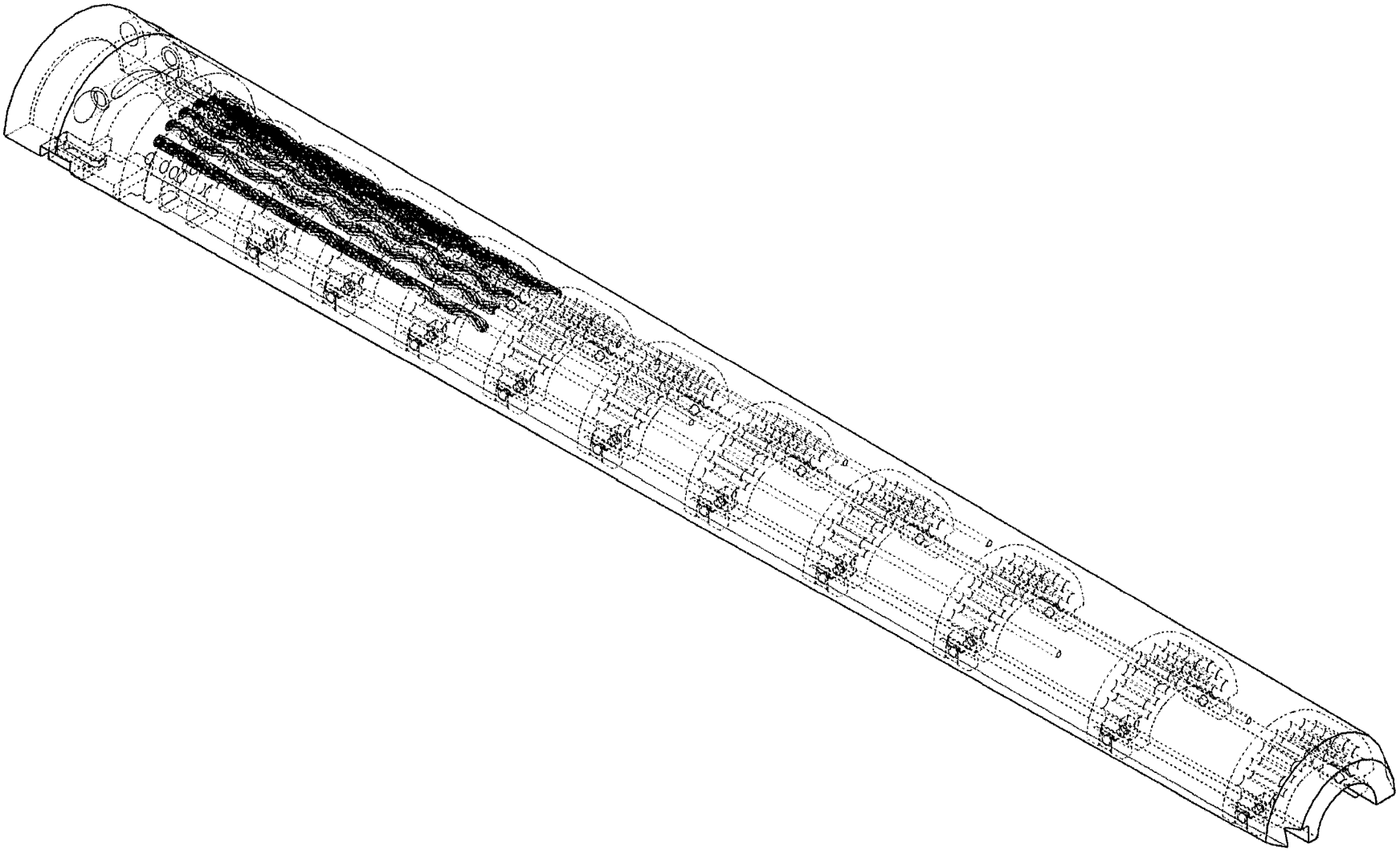
FIG. 28C is a perspective outline view of the second elongated BSR member with the plurality of rigid support members and a plurality of elongated stiffness members as composite rods as illustrated in FIG. 19 encapsulated in an elastomer.

FIGS. 28A, 28B 28C illustrate a perspective outline view of the second elongated BSR member with the plurality of rigid support members 140*b* and a plurality of elongated stiffness members as composite rods 710. FIG. 28C illustrates the assembly prior being and as encapsulated in an elastomer such as polyurethane.

Figure 29A:
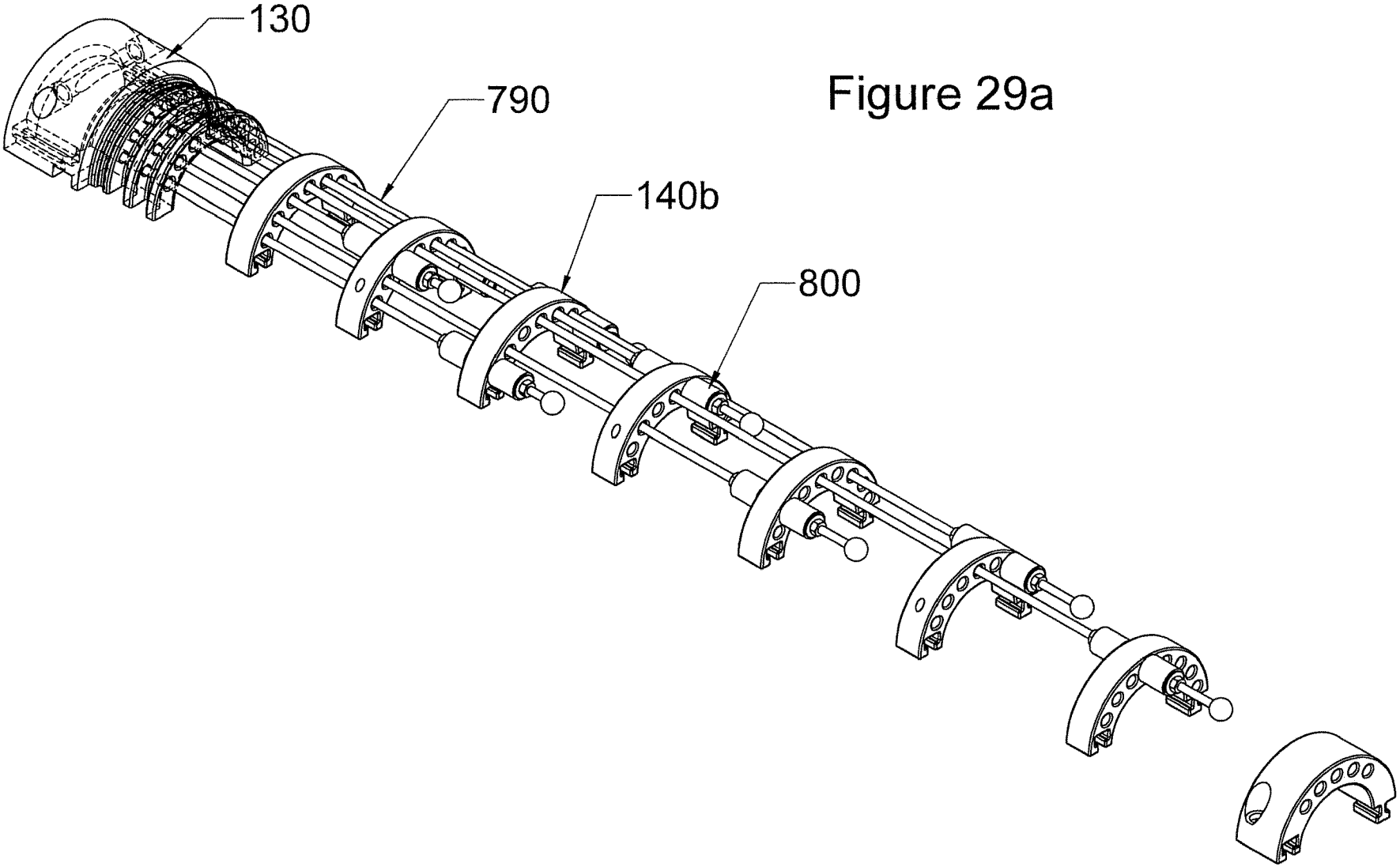
FIG. 29A is a perspective outline view of the second elongated BSR member with the plurality of rigid support members and a plurality of elongated stiffness members as stiffener rods with locks positioned along various support members.
Figure 29B:
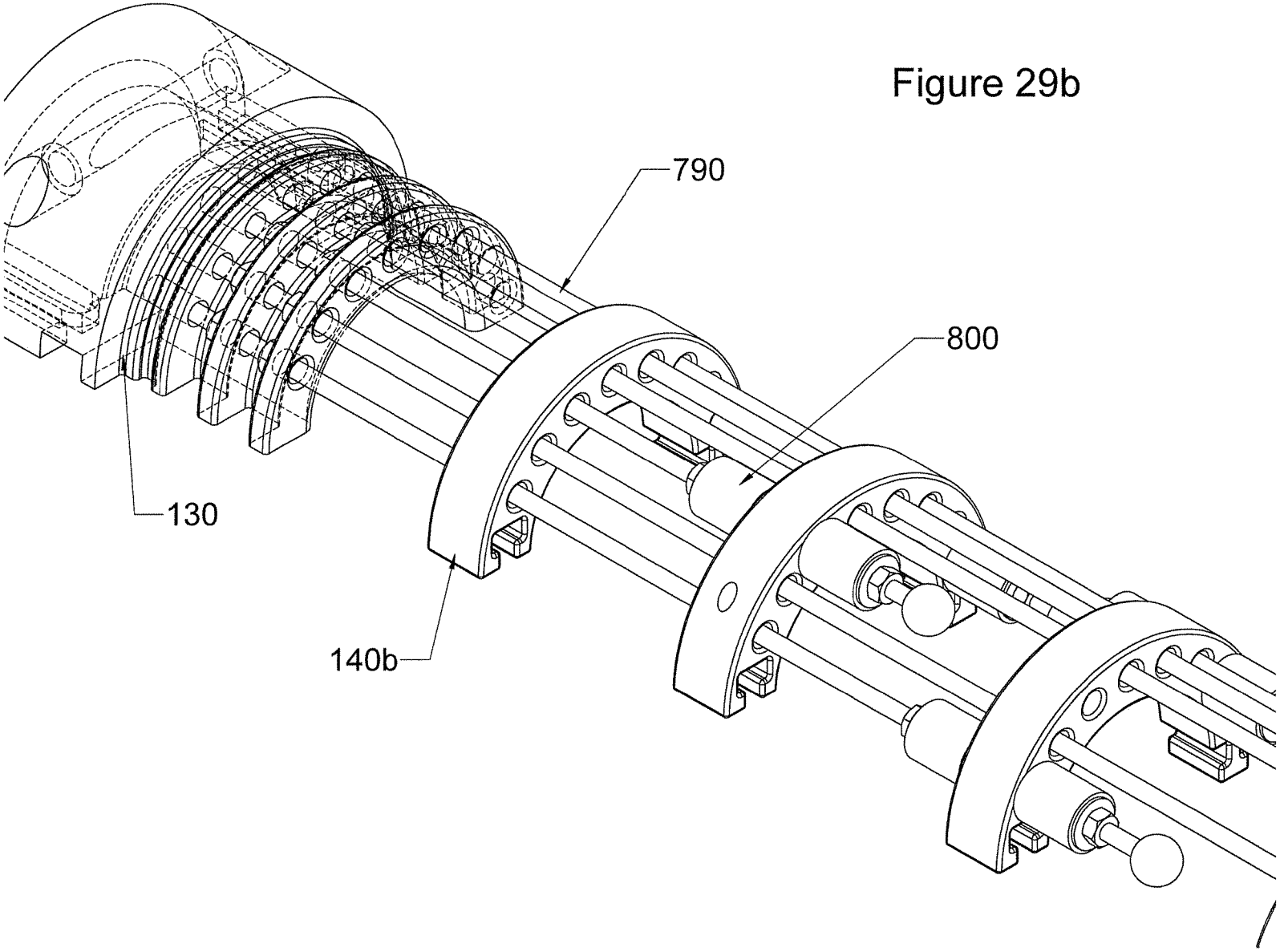
FIG. 29B is an enlarged perspective outline view of the second elongated BSR member of FIG. 29A with a plurality of elongated stiffness members as stiffener rods with locks.
Figure 29C:
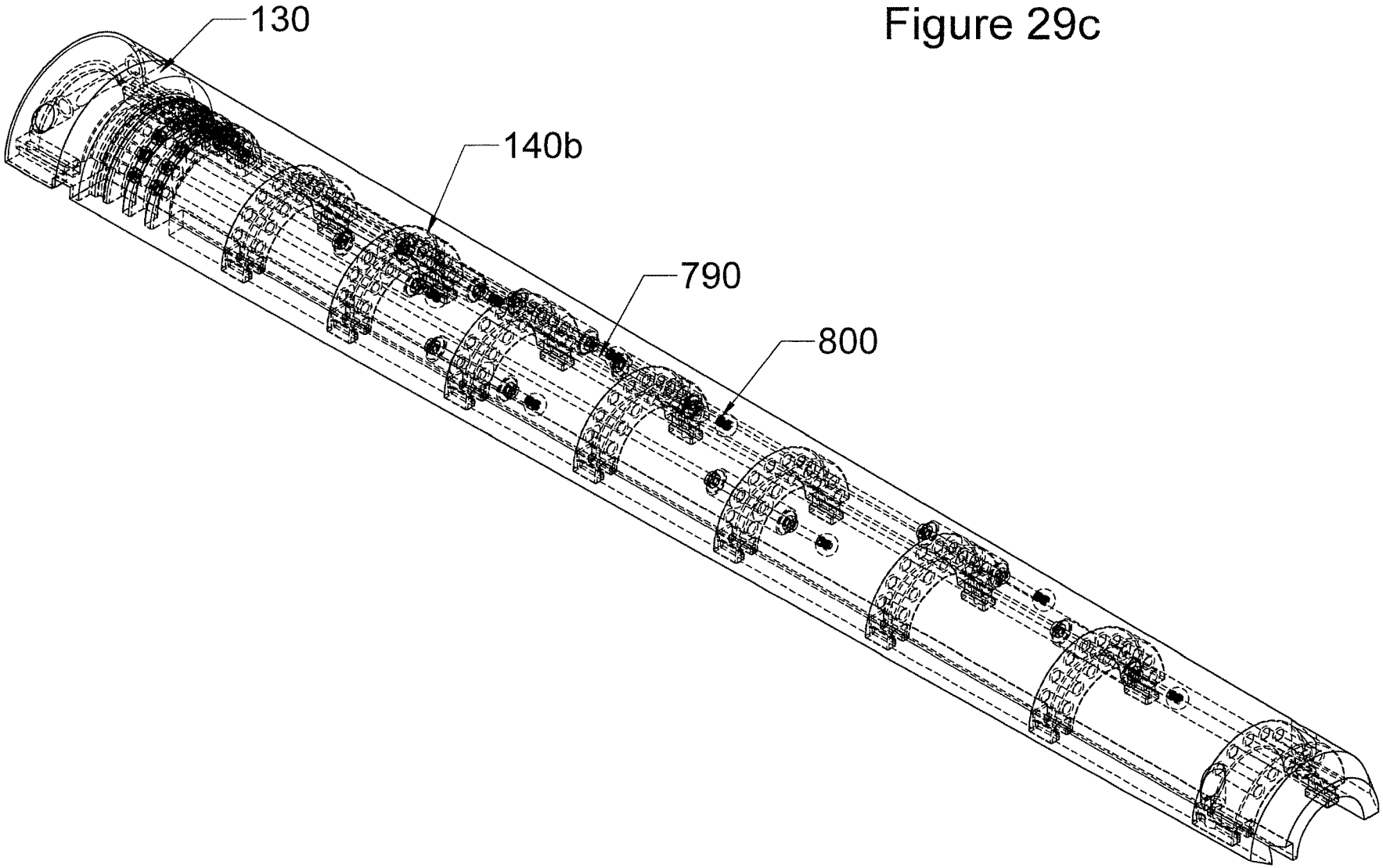
FIG. 29C is a perspective outline view of the second elongated BSR member with the plurality of rigid support members and a plurality of elongated stiffness members as stiffener rods with locks encapsulated in an elastomer.

FIGS. 29A and 29B outline views of the second elongated BSR member with the plurality of rigid support members 140*b* and a plurality of elongated stiffness members as stiffener rods 790 with locks 800 positioned along various support members. The stiffener rods 790 have various lengths wherein the locks 800 are positioned at various support members 140*b* wherein the rods are freely placed within the apertures of the support member and rigidly attached to the support member 140*b* having the lock 800. This arrangement varies the interaction of tension and compression by the length of the rods 790 and the compression of the elastomer encapsulation. FIG. 29C illustrates the assembly as it is encapsulated in an elastomer such as polyurethane.

The disclosure has been described with reference to the preferred embodiment. Modifications and alterations may be made upon reading and understanding this description. The present disclosure is intended to include such modifications and alterations in so far as they fall within the scope of the appended claims or the equivalents thereof.

What is claimed is:

1. A bending strain relief (BSR) assembly that limits the bending strain and radius of an associated cable, the BSR assembly comprising:

a coupler having a first end and an opposite second end with a longitudinal inner surface that extends from the first end to the second end;

a first elongated BSR member having a proximal end and a distal end spaced from the proximal end along a longitudinal axis with an inner arcuate surface that extends between the proximal end and the distal end, the first BSR member dimensioned for attachment to the coupler along a portion of an interface surface along the second end of the coupler and the proximal end of the first BSR member such that the inner arcuate surface is aligned with the longitudinal inner surface of the coupler; and a second elongated BSR member having a proximal end and a distal end spaced from the proximal end of the second elongated BSR member along the longitudinal axis with an inner arcuate surface, the second BSR member dimensioned for attachment to the coupler along a portion of the interface surface along the second end of the coupler and the proximal end of the second BSR member such that the inner arcuate surface of the second elongated BSR member is aligned with the longitudinal inner surface of the coupler;

wherein the associated cable is configured to be supported within the longitudinal inner surface and the inner arcuate surfaces of the first and second elongated BSR members;

axially spaced, rigid support members received in each of the elongated BSR members; and stiffness members received in at least one of the elongated BSR members and extending in an axial direction between the proximal and distal ends of a respective BSR member, and having a first end secured to one of the rigid support members, the stiffness members disposed in circumferential surrounding relation in the first and second elongated BSR members, wherein the stiffness members are wavy stiffness members and are disposed in multiple layers in the first and second elongated BSR members, where the multiple layers of wavy stiffness members are spaced in a radial direction where the radial direction is perpendicular to the longitudinal axis.

2. The BSR assembly of claim 1 wherein the rigid support members are generally aligned along a common axis and the inner arcuate surfaces of the first and second elongated BSR members.

3. The BSR assembly of claim 1 wherein the plurality of rigid support members are integrally molded to the first and second BSR members.

4. The BSR assembly of claim 1 wherein the interface surface comprises a contoured portion of an outer surface of the coupler that is adapted to abut to a contoured inner surface portion of the first and second BSR members.

5. The BSR assembly of claim 2 wherein the first and second elongated BSR members are slidably fastened to each other along an edge surface that extends between the proximal end and the distal end of the first and second elongated BSR members.

6. The BSR assembly of claim 5 wherein the edge surface includes a first surface and a second surface separate from the first surface, wherein the first and second surfaces are generally aligned on a common plane, and wherein the inner arcuate surface is between the first and second surfaces.

7. The BSR assembly of claim 1 wherein the wavy elongated stiffness members have different axial dimensions.

8. The BSR assembly of claim 1 wherein the BSR members are formed at least in part of an elastomer material.

9. The BSR assembly of claim 1 wherein the wavy elongated stiffness members have a generally sinusoidal shape.

10. The BSR assembly of claim 1 wherein a first end of the wavy elongated stiffness members are joined to one of an adapter or a rigid support member, and a second end of the wavy elongated stiffness members are joined to a rigid support member.

11. The BSR assembly of claim 1 wherein the plural wavy elongated stiffness members are in phase along the longitudinal length.

12. The BSR assembly of claim 1 wherein the wavy elongated stiffness members have one of a saw-tooth or sine wave configuration.

13. The BSR assembly of claim 1 wherein the wavy elongated stiffness members are a wire structure.

14. The BSR assembly of claim 1 wherein the rigid support members include apertures that receive a coupling link, opposite ends of which are joined to the wavy elongated stiffness member.

15. A bending strain relief (BSR) assembly that limits the bending strain and radius of an associated cable, the BSR assembly comprising:

a coupler having a first end and an opposite second end with a longitudinal inner surface that extends from the first end to the second end;

a first elongated BSR member having a proximal end and a distal end spaced from the proximal end along a longitudinal axis with an inner arcuate surface that extends between the proximal end and the distal end, the first BSR member dimensioned for attachment to the coupler along a portion of an interface surface along the second end of the coupler and the proximal end of the first BSR member such that the inner arcuate surface is aligned with the longitudinal inner surface of the coupler; and a second elongated BSR member having a proximal end and a distal end spaced from the proximal end of the second elongated BSR member along the longitudinal axis with an inner arcuate surface, the second BSR member dimensioned for attachment to the coupler along a portion of the interface surface along the second end of the coupler and the proximal end of the second BSR member such that the inner arcuate surface of the second elongated BSR member is aligned with the longitudinal inner surface of the coupler;

wherein the associated cable is configured to be supported within the longitudinal inner surface and the inner arcuate surfaces of the first and second elongated BSR members;

axially spaced, rigid support members received in each of the first and second elongated BSR members; and wavy stiffness members received in at least one of the elongated BSR members and extending in an axial direction between the proximal and distal ends of a respective BSR member, and having at least one end secured to one of the rigid support members, the wavy stiffness members disposed in circumferential surrounding relation in the first and second elongated BSR members, and disposed in multiple layers in the first and second elongated BSR members, wherein the multiple layers of wavy stiffness members are spaced in a radial direction where the radial direction is perpendicular to the longitudinal axis.

16. The BSR assembly of claim 15 further comprising links interconnecting axially adjacent wavy stiffness members.

17. The BSR assembly of claim 16 wherein the rigid support members include axially extending openings extending therethrough that receive the links interconnecting the axially adjacent stiffness members.

18. The BSR assembly of claim 15 wherein the wavy stiffness members are bonded to the respective BSR members.

19. The BSR assembly of claim 15 wherein the wavy elongated stiffness members have a generally sinusoidal shape.

20. The BSR assembly of claim 15 wherein a first end of a respective one of the wavy elongated stiffness members is joined to one of an adapter or one of the rigid support members, and a second end of a respective one of the wavy elongated stiffness members is joined to one of the rigid support members.

* * * * *